US007110696B2

(12) United States Patent
Murakami et al.

(10) Patent No.: US 7,110,696 B2
(45) Date of Patent: Sep. 19, 2006

(54) CLEANING UNIT, PROCESS CARTRIDGE, AND IMAGE FORMING APPARATUS

(75) Inventors: Eisaku Murakami, Tokyo (JP); Masami Tomita, Tokyo (JP); Masanori Kawasumi, Tokyo (JP); Toshio Koike, Tokyo (JP); Naohiro Kumagai, Tokyo (JP); Atsushi Sampe, Tokyo (JP); Takeshi Shintani, Tokyo (JP); Masato Yanagida, Tokyo (JP); Yutaka Takahashi, Tokyo (JP); Hiroya Hirose, Tokyo (JP); Shin Hasegawa, Tokyo (JP); Hiroyuki Nagashima, Tokyo (JP); Takeshi Uchitani, Tokyo (JP); Kazunori Karasawa, Tokyo (JP); Kentaroh Matsumoto, Tokyo (JP); Tokuya Ohjimi, Tokyo (JP); Mugijiroh Uno, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 20 days.

(21) Appl. No.: 10/668,311

(22) Filed: Sep. 24, 2003

(65) Prior Publication Data

US 2004/0136763 A1 Jul. 15, 2004

(30) Foreign Application Priority Data

| | | | |
|---|---|---|---|
| Sep. 24, 2002 | (JP) | ..... | 2002-276754 |
| Mar. 3, 2003 | (JP) | ..... | 2003-055089 |
| Jun. 24, 2003 | (JP) | ..... | 2003-179391 |

(51) Int. Cl.
*G03G 15/16* (2006.01)
*G03G 21/00* (2006.01)

(52) U.S. Cl. ..... 399/101; 399/347; 399/349

(58) Field of Classification Search ..... None
See application file for complete search history.

(56) References Cited

U.S. PATENT DOCUMENTS

| | | | | |
|---|---|---|---|---|
| 4,870,465 | A * | 9/1989 | Lindblad et al. | 399/347 |
| 4,931,841 | A * | 6/1990 | Yoshihara | 399/347 |
| 4,974,030 | A * | 11/1990 | Tokunaga et al. | 399/347 |
| 5,103,266 | A | 4/1992 | Miyamoto et al. | |
| 5,500,724 | A * | 3/1996 | Campbell et al. | 399/168 |
| 5,592,274 | A | 1/1997 | Higashi et al. | |
| 6,275,671 | B1 | 8/2001 | Hamada et al. | |
| 6,453,134 | B1 * | 9/2002 | Ziegelmuller et al. | 399/101 |
| 6,806,015 | B1 * | 10/2004 | Haneda et al. | 430/124 |

(Continued)

FOREIGN PATENT DOCUMENTS

EP 0 548 417 3/1994

(Continued)

OTHER PUBLICATIONS

Patent Abstract of Japan, JP 10-111629, Apr. 28, 1998.

(Continued)

*Primary Examiner*—Robert Beatty
(74) *Attorney, Agent, or Firm*—Oblon, Spivak, McClelland, Maier & Neustadt, P.C.

(57) ABSTRACT

A cleaning unit includes a first blade and a second blade. The first blade is in contact with an image carrier or a paper carrier and removes adhered substances remained on surface of these. The second blade has an abrasive layer that is formed by including abrasive particles in an elastic material and is disposed in the downstream side of the first blade. The second blade is allowed to be in contact with the image carrier 1 or the paper carrier. Volume occupancy of abrasive particles in an area of contact of the second blade with either the image carrier or the paper carrier is not less than 50 percent and not more than 90 percent.

47 Claims, 6 Drawing Sheets

U.S. PATENT DOCUMENTS

| | | | | |
|---|---|---|---|---|
| 6,846,604 | B1 * | 1/2005 | Emoto et al. | 430/110.3 |
| 2004/0234882 | A1 * | 11/2004 | Matsui et al. | 430/110.3 |

FOREIGN PATENT DOCUMENTS

| | | | | |
|---|---|---|---|---|
| EP | 1239334 | A1 | * | 9/2002 |
| JP | 57176083 | A | * | 10/1982 |
| JP | 59-200284 | | | 11/1984 |
| JP | 59200284 | A | * | 11/1984 |
| JP | 62-164376 | | | 10/1987 |
| JP | 1-112253 | | | 4/1989 |
| JP | 01161279 | A | * | 6/1989 |
| JP | 2-284158 | | | 11/1990 |
| JP | 03041455 | A | * | 2/1991 |
| JP | 3-65980 | | | 3/1991 |
| JP | 03152552 | A | * | 6/1991 |
| JP | 3-181952 | | | 8/1991 |
| JP | 03-200191 | | | 9/1991 |
| JP | 4-162048 | | | 6/1992 |
| JP | 04-317093 | | | 11/1992 |
| JP | 05027551 | A | * | 2/1993 |
| JP | 5-72808 | | | 3/1993 |
| JP | 5-188642 | | | 7/1993 |
| JP | 06-083165 | | | 3/1994 |
| JP | 9-15902 | | | 1/1997 |
| JP | 9-15903 | | | 1/1997 |
| JP | 10-111629 | | | 4/1998 |
| JP | 10-282724 | | | 10/1998 |
| JP | 11030938 | A | * | 2/1999 |
| JP | 11-133668 | | | 5/1999 |
| JP | 11-149180 | | | 6/1999 |
| JP | 2001209207 | A | * | 8/2001 |
| JP | 2001-296781 | | | 10/2001 |
| JP | 2002-162878 | | | 6/2002 |
| JP | 2002341614 | A | * | 11/2002 |

OTHER PUBLICATIONS

U.S. Appl. No. 11/100,813, filed Apr. 7, 2005, Ojimi et al.
U.S. Appl. No. 11/061,627, filed Feb. 22, 2005, Uno.
U.S. Appl. No. 11/090,565, filed Mar. 28, 2005, Toshio et al.
U.S. Appl. No. 11/060,421, filed Feb. 18, 2005, Koike et al.
U.S. Appl. No. 11/008,516, filed Dec. 10, 2004, Murakami et al.
U.S. Appl. No. 10/960,084, filed Oct. 8, 2004, Yamada et al.
U.S. Appl. No. 10/921,993, filed Aug. 20, 2004, Amemiya et al.
U.S. Appl. No. 10/921,923, filed Aug. 20, 2004, Koike et al.
U.S. Appl. No. 10/843,556, May 12, 2004, Karasawa.
U.S. Appl. No. 10/668,311, filed Sep. 24, 2003, Murakami et al.
U.S. Appl. No. 11/182,863, filed Jul. 18, 2005, Hosokawa et al.
U.S. Appl. No. 11/207,819, filed Aug. 22, 2005, Shintani et al.
U.S. Appl. No. 11/226,197, filed Sep. 15, 2005, Kimura et al.

* cited by examiner

CLEANING UNIT, PROCESS CARTRIDGE, AND IMAGE FORMING APPARATUS

BACKGROUND OF THE INVENTION

1) Field of the Invention

The present invention relates to a cleaning unit for cleaning of a rotator such as a photosensitive drum or a paper carrying belt, a process cartridge equipped with the cleaning unit, an image forming apparatus, and a toner used in the image forming apparatus.

2) Description of the Related Art

Color image forming apparatus that use electrophotography have been widely used in recent years. With easy availability of digitized image, more and more highly accurate printed image is demanded. While high resolution and gradation are being studied, as improvement in toner that visualizes latent image, the reduction of particle size and spherical particle size making of toner are being studied to form a highly accurate image.

For example, the following four methods of obtaining toner are proposed. In the first method, toner with spherical particle size and with specific particle size distribution is obtained by milling, as disclosed in Japanese Patent Application Laid Open Publications No. Hei1-112253, No. Hei2-284158, No. Hei3-181952, and No. Hei4-162048. In the second method, toner with small spherical particles is obtained by suspension polymerization, as disclosed in Japanese Patent Application Laid Open Publication No. Hei5-72808. In the third method, toner with small spherical particles is obtained by mixing a binder resin and a colorant in nonaqueous solvents and dispersing this mixture in an aqueous medium in the presence of a dispersion stabilizer, as disclosed in Japanese Patent Application Laid Open Publication No. Hei9-15902. In the fourth method, toner with small spherical particles is obtained by mixing a binder resin partially modified and a colorant in organic solvents, dispersing the mixture in an aqueous medium, and allowing to undergo polyaddition reaction of the modified resin, as disclosed in Japanese Patent Application Laid Open Publication No. Hei1-133668. Use of such toner improves image quality and fluidity of toner.

However, there are some problems with toner with small spherical particles. For example, during cleaning of toner not transferred and remained on a photosensitive drum using a cleaning blade, the spherical toner particles rotate between the blade and the photosensitive drum and enter the gap between the two, thereby making the cleaning difficult. To avoid this problem, a method of preparing toner with small random shaped particles is proposed in Japanese Patent Application Laid Open Publication No. Hei5-188642. In this method, a polymer obtained by suspension polymerization is heated in a dispersing medium beyond glass transition point to obtain an agglomerate. The agglomerate is introduced in a jet stream warmed up. Then the agglomerate is cracked and dried simultaneously to obtain the desired toner particles. Moreover, a method of preparing toner particles with rugged surface is proposed in Japanese Patent Application Laid Open Publication No. Hei9-15903. In this method, a binder resin and a colorant are mixed in nonaqueous solvents. This mixture is dispersed in an aqueous medium in the presence of a dispersion stabilizer and thereby suspension is obtained. The solvents and medium are removed from the suspension, by at least one of heating and pressure reduction to obtain the desired toner particles.

Moreover, wax and inorganic fine particles that are added internally or externally to improve mold releasing characteristics and fluidity respectively, are separated from the toner, and adhered on the photosensitive drum. This is another problem. Smaller is the particle size, more is the proportion of additives like wax, inorganic fine particles etc. Thus, there is a tendency towards increase in particles that adhere on the photosensitive drum.

A cleaning unit that includes a cleaning blade and a cleaning roller with an abrasive coated on the surface is proposed in Japanese Patent Application Laid Open Publication No. Hei10-111629, as a measure to remove the particles adhered to the photosensitive drum. However, the abrasive coated on the surface of the cleaning roller tend to come off and it is difficult to maintain good cleaning over a long period of time. Furthermore, in Japanese Patent Application Laid Open Publication No. 2001-296781, a structure to remove the particles adhered on the photosensitive drum in which an abrasive is stuck to the tip of the cleaning blade of the cleaning unit is proposed. However, it is difficult to clean the toner remaining after transferring of image and remove substance adhered to the surface simultaneously. In this structure with an abrasive stuck on the tip of the cleaning blade, the abrasive tend to come off.

However, with the conventional cleaning blade or the cleaning unit having a cleaning blade, it is difficult to remove sufficiently the substance adhered on the photosensitive drum. If the substance adhered contains wax as a main component, there is a thin filming on the surface of the photosensitive drum. If the substance adhered contains organic fine particles as a main component, these particles act as a core and grow bigger by up taking of additives like calcium carbonate etc. that are included in a recording paper, thereby deteriorating the image more and more as the time elapses. The contamination of an intermediate transferring body on which a toner image is transferred from the photosensitive drum and carried, is similar to that of the paper carrying belt that supports and carries a recording paper to which the toner image is transferred. Therefore, a cleaning unit that cleans surfaces of these components sufficiently is desired.

SUMMARY OF THE INVENTION

It is an object of the present invention to at least solve the problems in the conventional technology.

A cleaning unit, which is installed in an image forming apparatus, according to one aspect of the present invention includes a first blade located where a part of the first blade is in contact with a rotator constituting the image forming apparatus to remove residue on the rotator; and a second blade located where a part of the second blade is in contact with the rotator and having an abrasive layer, to remove residue not removed by the first blade.

A process cartridge, which is detachably installed in an image forming apparatus, according to another aspect of the present invention includes a rotator where residue is adhered in the image forming process; and a cleaning unit that has a first blade located where a part of the first blade is in contact with the rotator to remove residue on the rotator; and a second blade located where a part of the second blade is in contact with the rotator and having an abrasive layer, to remove residue not removed by the first blade.

A toner according to still another aspect of the present invention has a volume average particle size of approximately from 3 to 8 micrometers and a ratio Dv/Dn, of the volume average particle size Dv to a number average particle size Dn, of approximately from 1.00 to 1.40.

An image forming apparatus according to still another aspect of the present invention includes a rotator where residue is adhered in an image forming process; and a cleaning unit that has a first blade located where a part of the first blade is in contact with the rotator to remove residue on the rotator and a second blade located where a part of the second blade is in contact with the rotator and having an abrasive layer, to remove residue not removed by the first blade.

The other objects, features and advantages of the present invention are specifically set forth in or will become apparent from the following detailed descriptions of the invention when read in conjunction with the accompanying drawings.

DETAILED DESCRIPTION

Exemplary embodiment of a cleaning unit, a process cartridge, an image forming apparatus, and toner are described below based on drawings.

Figure 1:
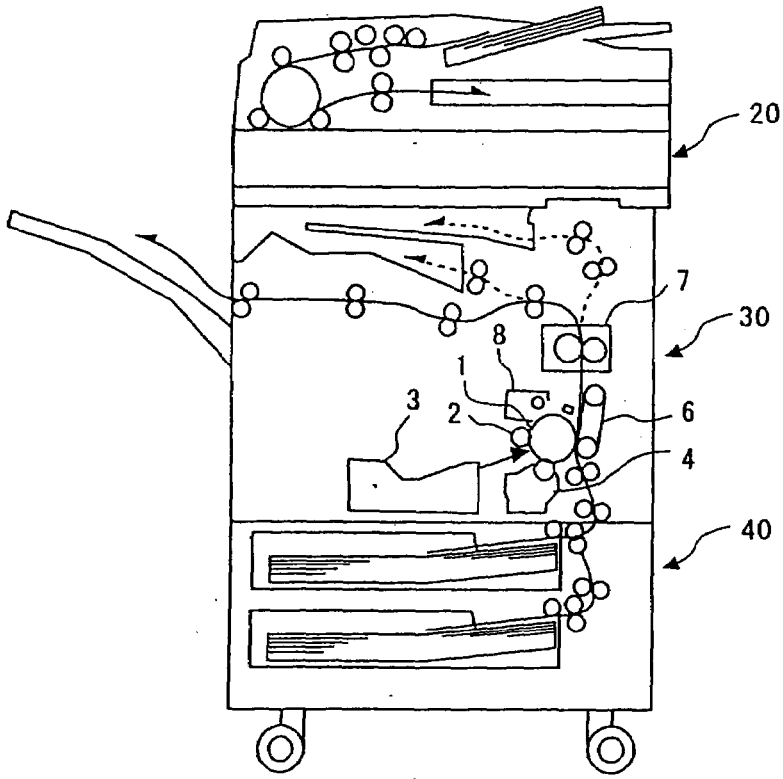
FIG. 1 is a schematic diagram of an image forming apparatus equipped with a cleaning unit for cleaning a surface of a photosensitive drum, in the present invention.
Figure 2:
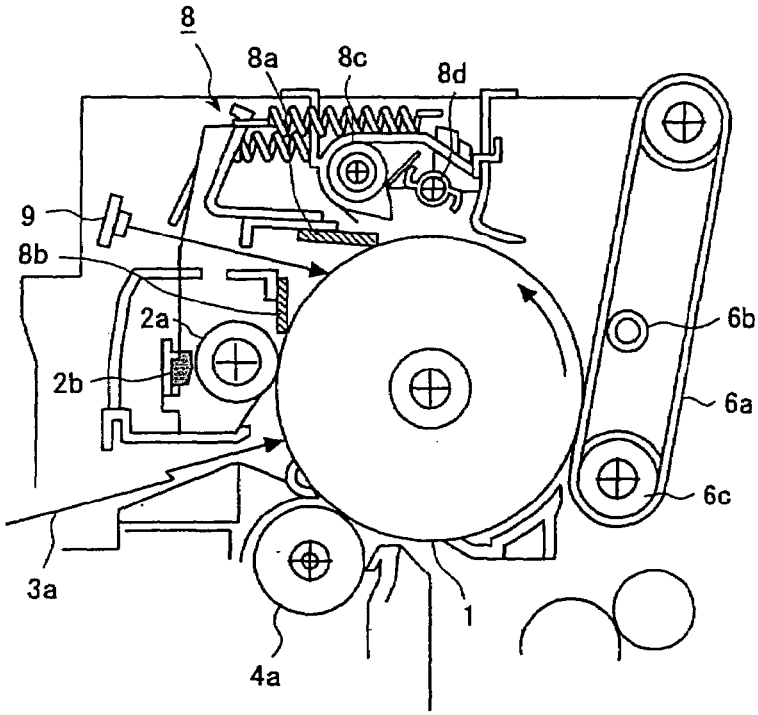
FIG. 2 is a schematic diagram of a structure around the photosensitive drum in the image forming apparatus equipped with the cleaning unit in the present invention.

FIG. 1 is a schematic diagram of an image forming apparatus equipped with a cleaning unit according to a first embodiment of the present invention. FIG. 2 is a schematic diagram of a structure around a photosensitive drum in the image forming apparatus equipped with the cleaning unit in the present invention. A charging unit 2, an exposing unit 3, a developing unit 4, a transferring unit 6, a fixing unit 7, and a cleaning unit 8 are disposed around a photosensitive drum 1 that is an image carrier.

An organic compound like bis-azo pigments and phthalocyanine pigments, an amorphous metal like amorphous silicon, amorphous selenium which are photoconductive, can be used for the photosensitive drum 1. Taking into consideration the environment and disposal after use, it is desirable to use a photosensitive drum having an organic compound. The charging unit 2 may be employing any one of a corona charging, a roller charging, a brush charging, and a blade charging. The charging unit 2 includes a charging roller 2*a*, a cleaning pad 2*b* that is in contact with the charging roller 2*a* for the purpose of cleaning, and a power supply that is in contact with the charging roller 3*a* but is not shown in the diagram. A high voltage is applied on the charging roller 2*a* thereby applying a predetermined voltage between the photosensitive drum 1 and the charging roller 2*a* having a curvature. Corona discharge is generated between the photosensitive drum 1 and the charging roller 2*a* thereby charging a surface of the photosensitive drum uniformly.

The exposing unit 3 converts data that is read by a scanner of a reading unit 20 and an image signal transmitted from outside like from a personal computer (hereinafter "PC"), which is not shown in the diagram, allows to scan a laser beam 3*a* by a polygon motor, and forms an electrostatic latent image on the photosensitive drum 1 based on the image signal that is read through a mirror. The developing unit 4 includes a developer carrier 4*a* that carries developer to the photosensitive drum 1 and a toner supplying chamber. It includes a cylindrical developer carrier 4*a* that is disposed in a position such that it maintains a minute gap from the photosensitive drum and a developer regulator that regulates the amount of the developer on the developer carrier 4*a*. The developer carrier 4*a* that is a rotatably supported hollow cylinder has a magnet roll that is fixed to the same shaft inside the hollow cylinder. Developer adheres magnetically on an outer peripheral surface of the developer carrier 4*a* and is carried further. The developer carrier 4*a* is formed by a photoconductive and non-magnetic material. A power supply for applying of developing bias is connected to this developer carrier 4*a*. The voltage is applied between the developer carrier 4*a* and the photosensitive drum 1 by the power supply, thereby forming an electric field in an area of developing.

The transferring unit includes a transfer belt 6*a*, a transfer bias roller 6*b*, and a tension roller 6*c*. The transfer bias roller 6*b* includes a core of any one of iron, aluminum, stainless steel etc. with a layer of an elastic material on its surface. To keep a paper in a close contact with the photosensitive drum 1, pressure necessary on the side of the photosensitive drum 1 is applied to the transfer bias roller 6*b*. Effectiveness of the transfer belt 6*a* depends on a heat resistant material that is selected as a base material of the belt. The transfer belt 6*a* can be made of a seamless polyimide film on an outer surface of which a layer of fluorine contained resin can be applied. Moreover, if it is necessary, a layer of silicone rubber may be provided on the polyimide film on which a layer of fluorine contained resin can also be applied. A tension roller 6*c* is provided on an inner side of the transfer belt 6*a* to drive the belt and to apply tension in the belt 6*a*.

The fixing unit 7 includes a fixing roller having a heater for heating a halogen lamp and a pressurizing roller that is in pressed contact. The fixing roller includes a core with a layer of an elastic material of 100 μm to 500 μm thickness, desirably of 400 μm thickness on it and an outer layer of a resin having good mold releasing property like that of a fluorine contained resin, to prevent adhesion of toner due to its viscosity. The outer resin layer is formed by a tetrafluoroethylene-perfluoroalkyl vinyl ether (PFA) tube and considering the mechanical deterioration of the layer, it is desirable that the thickness of this layer is in a range of 10

μm to 50 μm. A temperature detector is provided on an outer peripheral surface of the fixing roller and a heater is controlled to maintain almost a constant temperature of about 160° C. to 200° C. on the surface of the fixing roller. The pressurizing roller includes a core having an outer surface covered with a layer of an offset preventing material like PFA and polytetrafluoroethylene (PTFE). A layer of an elastic material like silicone rubber is provided on an outer surface of the core similar to that in the fixing roller.

Following is the detailed explanation of the cleaning unit in the present invention. The cleaning unit 8 includes two cleaning blades in order of a first cleaning blade 8*a* and a second cleaning blade 8*b* as a polishing blade from an upstream side of the direction of rotation of the photosensitive drum 1. The cleaning unit 8 further includes a toner recovery vane 8*d* that recovers the toner that is cleaned and a toner recovery coil 8*c* that carries the toner. The cleaning unit 8 also includes a toner recovery box that is not shown in the diagram. The first cleaning blade is made of a material like a metal, a resin, a rubber etc. and it is desirable to use fluorine contained rubber, silicone rubber, butyl rubber, butadiene rubber, isoprene rubber, and urethane rubber. Among these rubbers, the urethane rubber is particularly desirable. The first cleaning blade 8*a*, mainly removes toner that remains on the photosensitive drum 1 after transferring of an image.

The second cleaning blade 8*b* is a polishing blade that has a layer of abrasive particles formed by including abrasive particles in an elastic material. Apart from the toner that remain on the photosensitive drum, additives separated from the toner like inorganic fine particles and wax, and additives like calcium carbonate included in the recording paper adhere on the surface of the photosensitive drum after transferring of an image. These substances cause filming and result in lump formed on a core on the surface of the photosensitive drum 1. The second cleaning blade 8*b* is a polishing blade that removes these substances adhered on the photosensitive drum 1 by shaving them off. Hereinafter the second cleaning blade 8*b* is mentioned as the polishing blade 8*b*.

Figure 3:
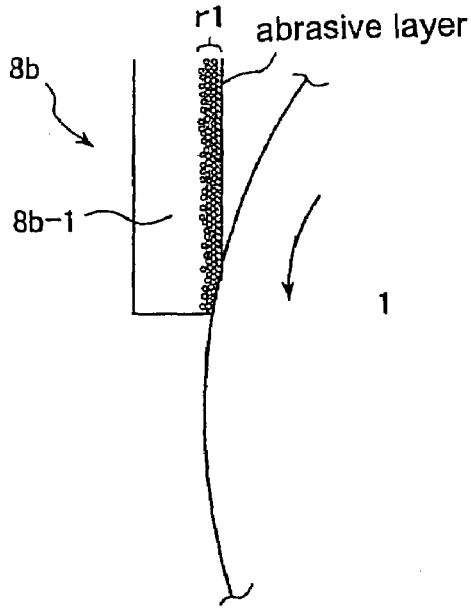
FIG. 3 is an illustration of a contact of a polishing blade with the surface of the photosensitive drum.

FIG. 3 is an illustration of contact of the polishing blade 8*b* with the photosensitive drum 1. The polishing blade 8*b* is installed such that a layer containing abrasive particles (hereinafter "abrasive layer") 8*b*-1 is in contact with the surface of the photosensitive drum. It is important that the contact surface of the polishing blade 8*b* is covered with abrasive particles. For this reason, the volume occupancy of abrasive particles on contact surface of the polishing blade 8*b* in the present invention is not less than 50 percent and not more than 90 percent. If the volume occupancy of the abrasive particles on the contact surface is less than 50 percent, the number of abrasive particles that come in contact with the surface of the photosensitive drum is less and the filming on the surface of the photosensitive drum cannot be eliminated effectively. If the volume occupancy of the abrasive particles on the contact surface is more than 90 percent, the abrasive particles on the surface tend to come off easily.

It is desirable that a tip of the polishing blade 8*b* in contact with the photosensitive drum 1 is over the length not less than 0.01 mm and not more than 5 mm. If the length is less than 0.01 mm, the area of contact is too small and sufficient polishing by the polishing blade cannot be achieved. Whereas, if the length is more than 5 mm, the area of contact is too large which decreases the bearing and sufficient polishing by the polishing blade cannot be achieved.

The polishing blade 8*b* may be either a single layered blade having only one abrasive layer 8*b*-1 or a double layered blade having the abrasive layer 8*b*-1 and a blade base layer. FIG. 3 is an illustration of a single layered blade. In case of the single layered blade, abrasive particles are mixed in an elastic material and a sheet is formed by centrifugal forming. This sheet is cut to make the polishing blade 8*b*. Thus, the simple manufacturing method of the polishing blade 8*b* is an advantage.

On the other hand, in a case of the double layered polishing blade, a thin sheet is formed with an elastic material and abrasive particles less than that for the single layered blade. This sheet is cut and stuck as a thin blade including a layer 8*b*-*a*, containing abrasive particles on the blade base layer made of any one of materials like rubber, resin, metal etc. In another method, a material like a resin, a metal etc. that forms the blade base layer is poured on the thin sheet that is formed by including the abrasive particles. An integrated sheet is formed by the centrifugal formation and this sheet is cut to make the blade. In the double layered blade the dimensions of the abrasive layer 8*b*-*a*, and the blade base layer have to be accurate. On the other hand the advantage of the double layered blade is that it can be designed for performing different functions by two layers, viz. the blade base layer that determines the physical properties like elasticity etc. and supports the abrasive layer 8*b*-1 and the abrasive layer 8*b*-1 that removes substance adhered on the surface of the photosensitive drum 1.

The examples of elastic materials for making the polishing blade 8*b* are fluorine contained resins, silicone rubber, butyl rubber, butadiene rubber, isoprene rubber, urethane rubber etc. Among these materials, urethane rubber is desirable from the abrasion and wear resistance point of view. Further, it is advisable to use rubber having hardness not less than 65 degrees and not more than 100 degrees, as the elastic material. If the hardness is less than 65 degrees, the blade wears away in a short time and if the hardness is more than 100 degrees, the edge of the blade tend to be chipped. It is more desirable that the hardness of the rubber is not less than 85 degrees and not more than 100 degrees. If the hardness is more than 85, the contact area between the polishing blade 8*b* and the surface subjected to polishing is reduced thereby increasing the bearing and enabling to improve the polishing. Moreover, with the hardness more than 85, the compressive strain inclined to the abrasive particles can be prevented thereby maintaining good polishing.

Moreover, similar effect can be achieved by applying the rubber material of greater hardness only on the front tip of the polishing blade 8*b* that is in contact with the photosensitive drum 1. Even if it is a material that is not having a greater hardness, a stiffening material like Mylar (trademark) can be stuck on the reverse side of the polishing blade 8*b* to make up for the hardness of the rubber thereby improving the polishing. This also enables to maintain the proper contact of the polishing blade 8 with the surface that is subjected to polishing.

Figure 4:
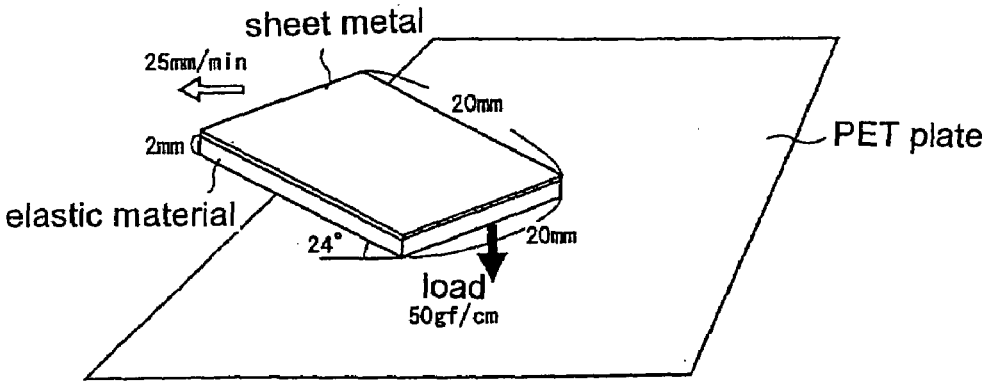
FIG. 4 is an illustration of a method for measurement of coefficient of dynamic friction of an elastic material.

It is desirable that the elastic material is a material having a low coefficient of dynamic friction. The coefficient of dynamic friction of a material can be measured by the following method. FIG. 4 is an illustration of a method for the measurement of coefficient of dynamic friction of an elastic material.

A sheet metal is stuck on an elastic material formed in a shape of a blade of 20 mm×20 mm×2 mm with a double-stick tape. An edge of the blade is allowed to be in contact with a 100 μm thick polyethylene terephthalate (PET) plate at an angle of 24 degrees. While applying the load of 50 gf/cm, the edge of the blade is pulled over the PET plate at a speed of 25 mm/min. The sliding resistance is detected during the movement of the edge and the coefficient of dynamic friction is determined.

It is desirable that the coefficient of dynamic friction determined is not more than 1.5. This reduces the force of friction between the polishing blade 8*b* and the surface that is subjected to polishing and also reduces the effect due to fluctuation in the force of friction, thereby preventing the variation in contact of the polishing blade 8*b* with the surface subjected to polishing. Thus, the constant polishing condition enables to maintain the proper polishing.

When a material having hardness not less than 85 degrees is used, if the coefficient of dynamic friction is high, the polishing blade 8*b* is dragged and contracted due to the effect of the force of friction between the polishing blade 8*b* and the surface subjected to polishing. This tends to chipping of edge of the blade. Whereas when a material having a low coefficient of dynamic friction is used, even if it is a rubber material having a greater hardness, a blade that is not chipped can be formed. The example of the elastic material having a coefficient of dynamic friction not more than 1.5 are, urethane rubber having its surface treated with fluorine, and urethane rubber that includes an element of fluorine.

The examples of abrasive particles are nitrides (e.g. silicon nitride), silicates (e.g. aluminum silicate, magnesium silicate, mica, calcium silicate), calcareous substances (e.g. calcium carbonate, gypsum), carbides (e.g. silicon carbide, boron carbide, tantalum carbide, titanium carbide, aluminum carbide, zirconium carbide), or oxides (e.g. ceric oxide, chromium oxide, titanium oxide, aluminum oxide) etc. Among these, ceric oxide is desirable as abrasive particles due to its excellent abrasive property.

It is desirable that the abrasive particle content in the abrasive layer 8*b*-1 on the polishing blade 8*b* is not less than 0.5 weight percent and not more than 50 weight percent. If the abrasive particle content is less than 0.5 weight percent, the number of abrasive particles that come in contact with the surface of the photosensitive drum 1 is too small and the substances adhered to the surface of the photosensitive drum 1 cannot be removed sufficiently. If the abrasive particle content is more than 50 weight percent, the formation of the polishing blade becomes difficult due to very high density of abrasive particles. The high abrasive particle content also leads to rise in cost.

The abrasive layer 8*b*-1 of the polishing blade 8*a* can have a gradient of volume occupancy during the step of centrifugal formation as shown in FIG. 3. Particularly, it is desirable that the thickness of a rich layer r1 of abrasive particles having volume occupancy not less than 50 percent, is not less than 5 μm and not more than 100 μm in a direction of thickness of the blade. If the thickness of the rich layer r1 is less than 5 μm, the number of abrasive particles that are in contact with the photosensitive drum 1 for is too small and the substance adhered to the surface of the photosensitive drum cannot be removed sufficiently. If the thickness of the rich layer r1 is more than 100 μm, the elasticity of the polishing blade 8*b* is affected and tends to chip the edge of the blade. The thickness of the rich layer r1 of the abrasive particles can be adjusted by increasing and decreasing the number of abrasive particles in the abrasive layer 8*b*-1 or the absolute number of abrasive particles that are used to form the abrasive layer 8*b*-1.

It is advisable to use a mixture of particles of different average particle size and of different materials as abrasive particles in the abrasive layer 8*b*-1. The use of mixture of different abrasive particles allows the use of different abrasion characteristics thereby enabling to remove the adhered substance like thin filming, a lump formed around a minute adhered substance as a core after elapsing of time etc. having different properties efficiently from the surface of the photosensitive drum 1.

It is particularly desirable that the abrasive layer includes ceric oxide of purity not less than 80 percent. Though the ceric oxide has excellent abrasive properties, the purity is as low as about 50 percent since it is manufactured by pulverizing of natural mineral ore. Therefore, salts of other rare earths having a good abrasive properties are mixed with ceric oxide. However, when such a mixture is used, there is a great difference in the physical properties and when such a mixture is used for the polishing blade, the abrasion is not uniform. Therefore, ceric oxide having purity of not less than 80 percent obtained by extraction of highly abrasive ceric oxide is a suitable abrasive with no difference in physical properties. The use of ceric oxide enables to have stable and high abrasive properties of the polishing blade 8*b*.

It is desirable that the average particle size of abrasive particles is not less than 0.05 μm and not more than 100 μm. If the average particle size is less than 0.05 μm, the particles are too fine and it is difficult to have a uniform dispersion of particles in the elastic material, thereby resulting in insufficient abrasion by the polishing blade. On the other hand, if the average particle size is more than 100 μm, the excessive abrasion causes scratches on the surface of the photosensitive drum 1.

Figure 5:
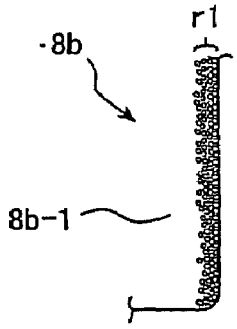
FIG. 5 is an enlarged view of an edge of the polishing blade.

Following is the explanation for a desirable shape of the edge of the polishing blade 8*b*. FIG. 5 is an enlarged view of the edge of the polishing blade 8*b*. As is shown in FIG. 3, the polishing blade 8*b* is installed such that the abrasive layer 8*b*-1 is in contact with the photosensitive drum 1 and it is desirable that the edge that is in contact with the photosensitive drum is shaped by cutting. When the edge of the polishing blade is viewed microscopically, it can be seen that the abrasive particles are not exposed and the outer layer is coated by a skin layer made of an elastic material like a thin rubber.

For this reason the abrasion by the polishing blade 8*b* in the initial stages of the use of the cleaning unit 8 is not sufficient. After using the cleaning unit for certain time when the surface of the edge of the polishing blade is shaved, the abrasive particles are exposed and polishing by the abrasion becomes effective. When the edge of the polishing blade is shaved, the abrasive particles are exposed and sufficient polishing effect can be achieved immediately after starting the use of the cleaning unit 8.

It is desirable that the curvature R of the edge of the polishing blade 8*b* in FIG. 5 is not less than 5 μm and not more than 150 μm. If the curvature R is less than 5 μm, the abrasive particles are not exposed on the surface of the edge due to very small curvature and polishing is not effective right from the start of use of the cleaning unit 8. If the curvature R is more than 150 μm, the area of contact between the abrasive layer 8*b*-1 and the surface subjected to polishing, increases due to large curvature. This results in decrease in bearing and deterioration of abrasion by the polishing blade.

For forming the edge of the polishing blade 8*b*, the elastic material and abrasive particles are mixed and a sheet is prepared by centrifugal formation. This sheet is cut to the shape of the blade and the edge of the blade is shaved off. To manufacture a polishing blade 8*b* that uses this edge effectively, it is desirable to form the curvature R of the edge simultaneously when the sheet is cut.

Figure 6A:
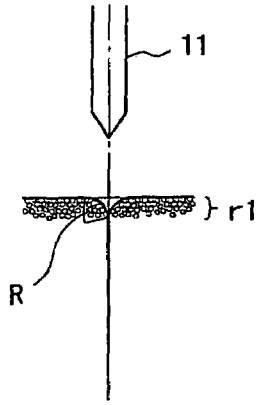
FIGS. 6A and 6B are schematic illustrations of sheet cutting during manufacturing of the polishing blade.
Figure 6B:
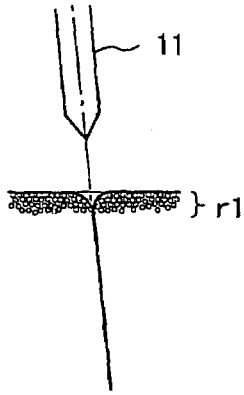

FIGS. 6A and 6B are schematic illustrations of sheet cutting during manufacturing of the polishing blade 8*b*. As is shown in FIG. 6A, a cutting edge of a cutter 11 like a razor or a round cutter is applied from the rich layer r1 of abrasive particles and the material is cut in the shape of the blade. During cutting, due to the frictional resistance of the surface being cut and the cutter 11, the rich layer r1 of abrasive particles close to the surface is tore off. This allows formation of curvature R of the edge of the polishing blade 8. The size of the curvature R can be adjusted by adjusting the shape of the cutter 11 and the cutting speed.

As is shown in FIG. 6B, the sheet may be cut by applying the blade of the cutter 11 inclined to the surface of the sheet rather than applying it perpendicularly. When the sheet is cut by inclining the blade of the cutter, the curvature of the polishing blade 8*b* on one side becomes large and the abrasive particles can be exposed easily on the cut surface of the blade.

On the other hand, the cleaning unit is installed in the image forming apparatus 100 without cutting the edge of the polishing blade 8*b*. The surface of the edge of the polishing blade may also be cut by bringing the polishing blade in contact with the photosensitive drum 1 and letting the idle running of the photosensitive drum 1. The abrasion by the polishing blade can be effective right from the initial use of the cleaning unit 8 by cutting the edge by the idle running immediately after the start of use of the cleaning unit 8.

It is advisable that the polishing blade 8*b* is in contact with the photosensitive drum 1 in a trailing form as shown in FIG. 2. If the polishing blade 8*b* is in contact in the trailing form, the capability of removing adhered substance on the photosensitive drum 1 is slightly deteriorated as compared to that with the contact in the countering form. However, since there is almost no toner input to the polishing blade 8, it is susceptible to bending and this bending is avoided by the contact of the polishing blade 8*b* in the trailing form.

It is desirable that the angle of contact of the polishing blade 8*b* in the trailing form with the photosensitive drum 1 is not less than 5 degrees and not more than 25 degrees. If the angle of contact is less than 5 degrees, the longitudinal surface of the polishing blade 8 comes in contact with the photosensitive drum 1, thereby causing creeping. The creeping hinders the abrasion capability of the polishing blade 8 in a course of time. If the angle of contact is more than 25 degrees, the polishing blade bends during the reverse rotation of the photosensitive drum 1 at the time of finishing of a job.

It is desirable that the contact pressure exerted by the polishing blade 8*b* on the photosensitive drum 1 is not less than 10 gf/cm and not higher than 80 gf/cm. If the contact pressure is less than 10 gf/cm, the substance adhered on the photosensitive drum 1, tends to run through due to the low contact pressure and the adhered substance cannot be removed sufficiently. If the contact pressure is higher than 80 gf/cm, the scraping of the thin filming on the photosensitive drum 1 increases and affects the life of the photosensitive drum. A dent is created on the surface of the photosensitive drum 1 by the edge of the polishing blade 8*b* due to the hardness of the polishing blade and the pressure of contact. It is desirable that the dent is not less than 0.2 mm and not more than 1.5 mm. If the polishing blade 8*b* is installed such that the dent is in this range, there is no excessive increase in the scraping of the thin filming of the surface of the photosensitive drum 1 and the polishing blade 8*b* can sufficiently remove the substance adhered on the surface of the photosensitive drum.

Thus, the cleaning unit 8 in the present invention is formed by integrating the photosensitive drum with optional units selected from the charging unit and the developing unit as a detachable process cartridge in the image forming apparatus. With this process cartridge, even for the image formation process with developing that uses toner of small particle size, good cleaning of the photosensitive drum can be maintained over a long period of time without any deterioration of image quality.

The cleaning unit in the present invention can be used for cleaning not only the surface of the photosensitive drum 1 but also the intermediate transferring body that is the second image carrier and the paper carrying belt that is the support of the recording member.

Figure 7:
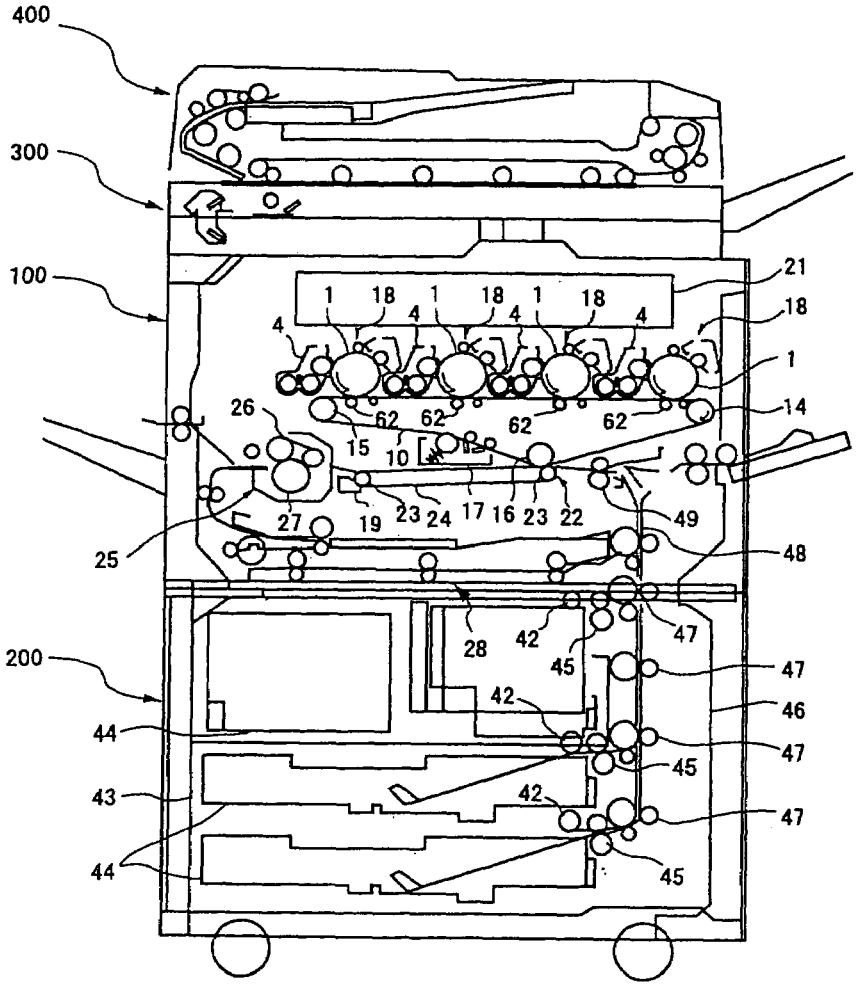
FIG. 7 is a schematic diagram of another structure of the image forming apparatus equipped with the cleaning unit in the present invention.

FIG. 7 is a schematic diagram of another structure of the image forming apparatus equipped with the cleaning unit in the present invention. In the figure, reference numeral 100 represents a copying unit, reference numeral 200 represents a paper feeding table on which the copying unit is mounted, reference numeral 300 represents a scanner that is fixed on the top of the copying unit 100, and reference numeral 400 represents an automatic document feeder (hereinafter "ADF"). The copying unit is equipped with a tandem image forming unit that includes four image forming units 18 in parallel. Each of the image forming unit 18 includes a photosensitive drum 1 around which various units necessary in electrophotography like a charging unit, a developing unit, cleaning unit etc. are disposed. An exposing unit 21 that forms a latent image by exposing the photosensitive drum 1 with a laser beam according to image information is provided on top of the tandem image forming unit. An intermediate transfer belt in the form of an endless belt is disposed in a position facing opposite the photosensitive drums 1 of the tandem image forming unit. Primary transferring units 62 are disposed opposite to the photosensitive drums 1 through the intermediate transfer belt 10. The primary transferring units 62 transfer toner images of each color formed on the photosensitive drums 1 to the intermediate transfer belt.

A secondary transferring unit 22 is disposed at the bottom of the intermediate transfer belt 100. The secondary transfer unit 22 collectively transfers the superimposed toner images on the intermediate transfer belt 10 to a paper medium that is carried from the paper feeding table 200. The secondary transferring unit 22 includes a secondary transfer belt 24 that is an endless belt put around two rollers 23 and is pressing against a supporting roller 16 sandwiching the intermediate transfer belt 10. The secondary transferring unit 22 transfers the toner image on the intermediate transfer belt 10 to the recording paper. The secondary transfer belt 24 also functions as a paper carrying belt. A fixing unit 25 that fixes the image on the paper medium is disposed next to the secondary transferring unit 22. The fixing unit 25 includes a fixing belt 26 that is an endless belt pressed against a pressurizing roller 27. An inverting unit 28 is disposed under the secondary transferring 22 and the fixing unit 25, at the bottom inside the copying unit. The inverting unit 28 turns over the recording paper for recording the images on both sides.

The intermediate transfer belt 10 is equipped with a cleaning unit 17 that cleans a surface of the intermediate transfer belt 10. The cleaning unit is disposed in a position on further downstream side of the direction of running of the belt from the position of transferring the image to the recording paper. The structure of the cleaning unit 17 is similar to that explained earlier and hence omitted here. The same cleaning unit may also be provided for the cleaning of the photosensitive drum 1 and the structure of the cleaning unit in the present invention can be employed in cleaning unit 19 of the secondary transfer belt 24. By installing the cleaning unit in the present invention, toner and substance adhered to the surface of the intermediate transferring body or the secondary transfer belt can also be cleaned effectively. Moreover, the effective cleaning capability can be maintained over a long period of time thereby preventing deterioration of image quality.

Installing of the cleaning unit in the present invention is remarkably effective in an image forming apparatus in which the toner used in the developing unit 4 has small particles having the volume average particle size in a range of 3 μm to 8 μm, having a ratio Dv/Dn of the volume average particle size Dv and the number average particle size Dn is in a range of 1.00 to 1.40, and having narrow particle size distribution. The toner having a small particle size can be adhered accurately on the latent image. Moreover, by narrowing the particle size distribution, the charging distribution of the toner becomes uniform. Thus a high quality image having less fogging on the surface can be achieved and transferring rate can be improved.

On the other hand, in such type of toner, the proportion of wax that is added externally or internally to the toner particles to improve the mold releasing property and inorganic fine particles that are used to improve the fluidity is higher due to the small particle size as compared to that of the conventional toner. These additives are a cause of substances that adhere to the surface of the photosensitive drum 1. Therefore, the toner remained after the transferring of an image and the paper dust is removed by the first cleaning blade 8*a* in the cleaning unit in the present invention. The substances adhered that include wax and inorganic fine particles as main components are removed by scraping by the polishing blade 8*b* on the downstream side. The toner and paper dust that is escaped from the first cleaning blade 8*a* can also be removed by the polishing blade 8*b*. Since the polishing blade 8*b* has a thick abrasive layer 8*b*-1 that contains abrasive particles, the abrasive particles do not come off. Therefore, good cleaning capability can be maintained over a long period of time.

The toner suitable to the image forming apparatus in the present invention is prepared by allowing to disperse a toner material solution consisting of at least a polyester prepolymer having a functional group that includes nitrogen atoms, a polyester, a colorant, and a mold releasing agent, in an organic solvent and then allowing to undergo a cross linking reaction and/or an extension reaction in an aqueous medium. Following is the explanation of constituent materials and a method for manufacturing of the toner.

The toner in the present invention contains modified polyester (i) as a binder resin. Modified polyester means a polyester in which there is a bonding group present other than an ester bond in the polyester resin and resinous principles having a different structure in the polyester resin are bonded by a bond like covalent bond and ion bond. Concretely, it means a polyester terminal that is modified by introducing a functional group like an isocyanate group that reacts with a carboxylic acid group, a hydroxyl group to a polyester terminal and then allowed to react with a compound containing active hydrogen.

The example of a modified polyester (i) is a urea modified polyester that is obtained by allowing to react a polyester prepolymer (A) having an isocyanate group with an amine (B). The examples of polyester prepolymer (A) having an isocyanate group are condensates of polyhydric alcohols (PO) and polyhydric carboxylic acids (PC) and furthermore polyester prepolymers obtained by allowing to react a polyester having an active hydrogen group with a polyhydric isocyanate compound (PIC). The examples of the active hydrogen groups are hydroxyl groups (alcoholic hydroxyl group and phenolic hydroxyl group), amino group, carboxyl group, mercapto group, among which the alcoholic hydroxyl group is desirable.

A urea modified polymer is prepared as given below. The examples of polyhydric alcohol compounds (PO) are dihydric alcohols (DIO) and polyhydric alcohols not below trihydric alcohol (TO). Solely the dihydric alcohol (DIO) or a mixture of a small quantity of trihydric alcohol (TO) with a dihydric alcohol (DIO) is desirable. The examples of dihydric alcohol (DIO) are, alkylene glycols (e.g. ethylene glycol, 1,2-propylene glycol, 1,3-propylene glycol, 1,4-butanediol, and 1,6-hexanediol), alkylene ether glycols (e.g. diethylene glycol, triethylene glycol, dipropylene glycol, polyethylene glycol, polypropylene glycol, and polytetramethylene ether glycol), alicyclic diols (e.g. 1,4-cyclohexane dimethanol, and hydrogen additive bisphenol A), bisphenols (e.g. bisphenol A, bisphenol F, and bisphenol S), adducts of alkylene oxides of these alicyclic diols (e.g. ethylene oxides, propylene oxides, and butylene oxides), and adducts of alkylene oxides of the phenols (e.g. ethylene oxides, propylene oxides, and butylenes oxides). Adducts of alkylene oxides of the bisphenols and alkylene glycols having a carbon number from 2 to 12 are desirable. The adducts of alkylene oxides of bisphenols and the adducts of alkylene oxides of bisphenols together with the alkylene glycols having a carbon number from 2 to 12 are particularly desirable. The examples of polyhydric alcohols not below trivalent alcohols (TO) are polyhydric aliphatic alcohols from trivalent to octavalent alcohols and above (e.g. glycerin, trimethylol ethane, trimethylol propane, pentaerythritol, and sorbitol), phenols not below trivalent phenols (e.g. trisphenol PA, phenol novolak, and cresol novolak), and adducts of alkylene oxides of polyphenols not below trivalent polyphenols.

The examples of polyhydric carboxylic acid (PC) are dihydric carboxylic acid (DIC) and polyhydric carboxylic acids not below trivalent carboxylic acid (TC). Solely the dihydric carboxylic acid (DIC) or a mixture of a small quantity of trihydric carboxylic acid (TC) with a dihydric carboxylic acid (DIC) is desirable. The examples of dihydric carboxylic acid are alkylene dicarboxylic acids (e.g. succinic acid, adipic acid, and sebacic acid), alkenylene dicarboxylic acids (e.g. maleic acid, and fumaric acid), and aromatic dicarboxylic acids (e.g. phthalic acid, isophthalic acid, terephthalic acid, and naphthaline dicarboxylic acid). Among these, the alkenylene dicarboxylic acids having a carbon number from 4 to 20 and the aromatic dicarboxylic acids having a carbon number from 8 to 20 are desirable. The examples of the polyhydric carboxylic acids not below the trivalent carboxylic acid are aromatic polyhydric carboxylic acids having a carbon number from 9 to 20 (e.g. trimellitic acid and pyromellitic acid). The acid anhydrides and low alkyl esters of these can be used as polyhydric carboxylic acids and may be allowed to react with the polyhydric alcohols (PO).

The ratio of the polyhydric alcohol (PO) and the polyhydric carboxylic acid (PC) is an equivalent ratio [OH]/[COOH] of a hydroxyl group [OH] and a carboxyl group [COOH] and is generally in a range of 2/1 to 1/1. The desirable ratio is in a range of 1.5/1 to 1/1 and a range of 1.3/1 to 1.02/1 is particularly desirable.

The examples of polyhydric isocyanate compounds (PIC) are aliphatic polyhydric isocyanates (e.g. tetramethylene diisocyanate, hexamethylene diisocyanate, and 2,6-diisocyanate methyl caproate), alicyclic polyisocyanates (e.g. isophorone diisocyanate and cyclohexylmethane diisocyanate), aromatic diisocyanates (e.g. tolylene diisocyanate and diphenyl methane diisocyanate), aromatic aliphatic diisocyanates (e.g. α,α,α',α'-tetramethyl xylynene diisocyanate), isocyanates, compounds formed by blocking of these polyisocyanates by a phenol derivative, an oxime, and a caprolactum, and a combination of more than any one of these.

The ratio of the polyhydric isocyanate compound (PIC) is an equivalent ratio [NCO]/[OH] of an isocyanate group [NCO] and a hydroxyl group [OH] of a polyester and is generally in a range of 5/1 to 1/1. The desirable ratio is in a range of 4/1 to 1.2/1 and a range of 2.5/1 to 1.5/1 is particularly desirable. If the ratio of [NCO]/[OH] is more than 5, the fixing of an image at a low temperature is affected. If the mole ratio of [NCO] is less than 1, in a case where urea non-modified polyester is used, the urea content in the ester becomes low, thereby affecting the offset resistance.

The content of the polyhydric isocyanate compound (PIC) in the polyester prepolymer (A) having an isocyanate group, is normally in a range of 0.5 weight percent to 40 weight percent. The desirable range of the content of the polyhydric isocyanate compound is 1 weight percent to 30 weight percent and a range of 2 weight percent to 20 weight percent is more desirable. If the content of the polyhydric isocyanate compound is less than 0.5 weight percent, the hot offset resistance is deteriorated and it is unfavorable from the point of view of compatibility of heat conserving resistance and fixing at a low temperature. On the other hand, if the content of the polyhydric isocyanate compound is more than 40 weight percent, there is a deterioration of fixing at a low temperature. The content of the isocyanate group per molecule in the polyester prepolymer (A) having an isocyanate group is normally 1. The desirable range of the content of the isocyanate group is on average 1.5 to 3 and a range of 1.8 to 2.5 is more desirable. If the content of the isocyanate group per molecule is less than 1, then the molecular weight of the urea-modified polyester becomes low and the hot offset resistance is deteriorated.

Further, the examples of amines (B) that are allowed to react with the polyester prepolymers (A) are dihydric amine compounds (B1), polyhydric amine compounds (B2) not below trivalent amines, amino alcohols (B3), amino mercaptans (B4), amino acids (B5), and compounds (B6) in which the amino groups from B1 to B5 are blocked. The examples of dihydric amine compounds (B1) are aromatic diamines (e.g. phenylene diamine, diethylene diamine, and 4,4'-diamino diphenyl methane), alicyclic diamines (e.g. 4,4'-diamino-3,3'-dimethyl dicyclohexyl methane, diamine cyclohexane, and isophorone diamine), and aliphatic diamines (e.g. ethylene diamine, tetramethylene diamine, and hexamethylene diamine). The examples of polyhydric amine compounds (B2) not below trivalent amine are diethylene triamine and triethylene tetramine. The examples of amino alcohols (B3) are ethanol amine and hydroxyethyl aniline. The examples of amino mercaptans (B4) are amino ethyl mercaptan and amino propyl mercaptan. The examples of amino acids (B5) are amino propionic acid and amino caproic acid. The examples of compounds (B6) in which the amino groups from B1 to B5 are blocked are ketimine compound and oxazolidine compounds obtained from the ketones and amines in B1 to B5 above (e.g. acetone, methyl ethyl ketone, and methyl isobutyl ketone). The desirable amines among the amines (B) are B1 and mixtures of B1 with a small amount of B2.

The ratio of amines is an equivalent ratio [NCO]/[NHx] of an isocyanate group [NCO] in the polyester prepolymers (A) having an isocyanate group and an amine group [NHx] in the amines (B) and is generally in a range of 1/2 to 2/1. The desirable ratio is in a range of 1.5/1 to 1/1.5 and a range of 1/2/1 to 1/1.2 is particularly desirable. If the ratio of [NCO]/[NHx] is more than 2 or less than 1/2, the molecular weight of the urea-modified polyester decreases and the hot offset resistance is deteriorated. Moreover, a urethane bond may be included together with a urea bond in the urea-modified polyester. The mole ratio of the urea bond content and the urethane bond content is normally in a range of 100/0 to 10/90. The desirable ratio is in a range of 80/20 to 20/80 and a range of 60/40 to 30/70 is more desirable. If the mole ratio of the urea bond is less than 10 percent, the hot offset resistance is deteriorated.

The modified polyester (i) that is used in the present invention is manufactured by a method like a one-shot method and a prepolymer method. The weight average molecular weight of the modified polyester (i) is normally not less than 10,000. The desirable weight average molecular weight is in a range of 20,000 to 10,000,000 and the weight average molecular weight in a range of 30,000 to 1,000,000 is more desirable. Here, the desirable range of the peak molecular weight is 1,000 to 10,000. If it is less than 1,000, it becomes difficult to carry out the extension reaction due to which the elasticity of toner is low, thereby deteriorating the hot offset resistance. If the peak molecular weight is more than 10,000, the fixing of the image is deteriorated and there are problems in the manufacturing regarding small particle size and pulverization. The number average molecular weight of the modified polyester (i) is not restricted only in a case of using the non-modified polyester (ii) that is mentioned later and may be a number average molecular weight that is suitable to obtain the weight average molecular weight. If the modified polyester (i) is used solely, the number average molecular weight is normally not more than 20,000 and is desirably in a range of 1,000 to 10,000. A range of 2,000 to 8,000 is more desirable. If the number average molecular weight is more than 20,000, the fixing at a low temperature and the gloss when a full color unit is used, are deteriorated. A reaction inhibitor can be used if necessary in cross linking reaction and/or extension reaction between the polyester prepolymer (A) and the amine (B) to obtain a modified polyester (i), to adjust the molecular weight of the urea-modified polyester that is obtained. The examples of the reaction inhibitors are monoamines (e.g. diethyl amine, dibutyl amine, butyl amine, and lauryl amine) and the compounds in which these are blocked (e.g. ketimine compounds).

In the present invention, the modified polyester (i) can not only be used solely but also can be mixed together with a non-modified polyester (ii) contained as a binder resinous principle. By using (ii) together with (i), there is an improvement in the fixing at a low temperature and the gloss when a full color unit is used. Therefore, the use of (i) together with (ii) is desirable that using (i) solely. The examples of (ii) are the polycondensates of polyhydric alcohols (PC) and polyhydric carboxylic acids (PC) similar to the polyester component of (i). The desirable examples are as well similar to that of (i). Moreover, (ii) is not only non-modified polyester and may be a compound modified by a chemical bond other than the urea bond like a compound modified by a urethane bond. From the point of view of the fixing at a low temperature and the hot offset resistance, it is desirable that (i) and (ii) are at least partly compatible. Therefore, it is desirable that (ii) and the polyester component of (i) have similar composition. The weight ratio of (i) and (ii) when (ii) is included in (i), is normally in a range of 5/95 to 80/20. The weight ratio in a range of 5/95 to 30/70 is desirable and a range of 5/95 to 25/75 is more desirable. The weight ratio in a range of 7/93 to 20/80 is further more desirable. If the weight ratio of (i) is less than 5 percent, the hot offset resistance is deteriorated and it is unfavorable from the point of view of compatibility of heat conserving resistance and fixing at a low temperature.

The peak molecular weight of (ii) is normally in a range of 1,000 to 10,000. The desirable range is from 2,000 to 8,000 and a range of 2,000 to 5,000 is more desirable. If the peak molecular weight is less than 1,000, the heat conserving resistance is deteriorated and if it is less than 10,000, the fixing at a low temperature is deteriorated. It is desirable that the hydroxyl value of (ii) is not less than 5. The value in a range of 10 to 120 is more desirable and a range of 20 to 80 is particularly desirable. If the hydroxyl value is less than 5, it is unfavorable from point of view of compatibility of the heat conserving resistance and the fixing at a low temperature. It is desirable that the acid value of (ii) is in a range of 1 to 5 and a range of 2 to 4 is more desirable. Since a wax having a high acid value is used, the binder is a low acid value binder resulting in charging and high volume resistance. Therefore, it is easy to match the binder that matches with the toner that is used in a two-component developer.

The glass transition point (Tg) of binder resin is normally in a range of 35° C. to 70° C. and the desirable range is from 55° C. to 65° C. If the glass transition point (Tg) is less than 35° C., the heat conserving resistance of the toner is deteriorated and if it is more than 70° C., the fixing at a low temperature is insufficient. Since the urea-modified polyester tend to exist on the surface of the host particles of the toner obtained, even if the glass transition point is lower as compared to that of the know polyester based toners, it has a tendency to have good heat conserving resistance.

All known dyes and pigments can be used as colorants. For example, carbon black, nigrosin dye, iron black, naphthol yellow S, hanza yellow (10G, 5G, and G), cadmium yellow, yellow iron oxide, ocher, chrome yellow, titan yellow, polyazo yellow, oil yellow, hanza yellow (GR, A, RN, and R), pigment yellow L, benzidine yellow (G and GR), permanent yellow (NCG), vulcun fast yellow (5G and R), tartazine lake, quinoline yellow lake, anthrazan yellow BGL, isoindolinone yellow, bengala (Indian red), red lead (minium), vermilion lead, cadmium red, cadmium mercury red, antimony red, permanent red 4R, para red, fisse red, red (F2R, F4R, FRL, FRLL, and F4RH), fast scarlet VD, vulcun fast rubin B, brilliant scarlet G, lithol rubin GX, permanent red F5R, brilliant carmine 6B, pigment scarlet 3B, Bordeaux 5B, toluedine maroon, permanent Bordeaux F2K, helio Bordeaux BL, Bordeaux 10B, bon maroon light, bon maroon medium, eosin lake, rhodamine lake B, rhodamine lake Y, alizarine lake, thioindigo red B, thioindigo maroon, oil red, quinacridone red, pyrazolone red, polyazo red, chrome vermilion, benzidine orange, perynone red, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine blue, Prussian blue, anthraquinone blue, fast violet B, methyl violate lake, cobalt violet, manganese violet, dioxane violet, anthraquinone violet, chrome green, zinc green, chromium oxide, pyridian, emerald green, pigment green B, naphthol green B, green gold, acid green lake, malachite green lake, phthalocyanine green, anthraquinone green, titanium oxide, Chines white (zinc oxide), lithophone, and mixtures of these can be used as pigments and dyes. The content of colorant in the toner is normally from 1 weight percent to 15 weight percent of that of the toner, the desirable content being from 3 weight percent to 10 weight percent.

The colorants can also be used as a master batch mixed with a resin. The examples of binder resins to be kneaded with the master batch or used in the preparation of the master batch are styrenes like polystyrene, poly-p-chlorostyrene, polyvinyl toluene and polymers of their substitutes, or copolymers of these with a vinyl compound, polymethyl metacrylate, polybutyl metacrylate, polyvinyl chloride, polyvinyl acetate, polyethylene, polyester, epoxy resins, epoxy polyol resins, polyurethane, polyamides, polyvinyl butyral, polyacrylic resins, rosin, modified rosin, terpene resins, aliphatic and alicyclic hydrocarbon resins, aromatic petroleum resins, chlorinated paraffins, paraffin wax etc. which can be used solely or by mixing.

The known charge controlling agents that can be used are nigrosin based dyes, triphenyl methane based dyes, chrome contained metal complex dyes, molybdic acid chelate pigments, rhodamine based pigments, alkoxy amines, quaternary ammonium salts (including fluorine modified quaternary ammonium salts), alkyl amides, simple substances or compounds of phosphorus, simple substances or compounds of tungsten, fluorine based activating agents, metal salts of salicylic acid, and metal salts of salicylic acid derivatives etc. The concrete examples are BONTRON 03 as a nigrosin based dye, BONTRON P-51 as a quaternary ammonium salt, BONTRON S-34 as metal contained azo pigments, E-82 as an oxynaphtholic acid based metal complex, E-84 as a salicylic acid based metal complex, E-89 as a phenol based condensate (all manufactured by ORIENT CHEMICAL INDUSTRIES, LTD.), TP-302 and TP-415 (manufactured by HODOGAYA CHEMICAL COMPANY, LTD.) as quaternary ammonium salt molybdenum complexes, COPY CHARGE PSY VP2038 as a quaternary ammonium salt, COPY BLUE PR as a derivative of triphenyl methane, COPY CHARGE NEGVP2036 and COPY CHARGE NX VP434 as quaternary ammonium salts (all manufactured by HOECHST CO., LTD.), LRA-901, LRA-147 as a boron complex (manufactured by JAPAN CARLIT CO., LTD.), copper phthalocyanine, perylene, quinacridone, azo based pigments, and compounds having high molecules having other sulfonic groups, carboxyl groups, and functional groups having quaternary ammonium salt. Among these, the materials that charge the toner negatively are particularly desirable. The quantity of the charge controlling agent is determined by a type of a binder resin that is used, presence or absence of any additive used according to need, a method of manufacturing of toner including a method of dispersion, and is not restricted to a fixed quantity. The desirable quantity is in a range of 0.1 parts to 10 parts of weight per 100 parts of weight of a binder resin. The more desirable range is from 0.2 parts to 5 parts of weight. If the quantity is more than 10 parts of weight, there is an excessive charging of the toner and deteriorates the effect of the charge controlling agent. Moreover, the electrostatic absorption force of the developing roller increases, thereby affecting the fluidity of the developer and the image density.

A wax having a low melting point in a range of 50° C. to 120° C., functions effectively between the fixing roller and surface of toner particles as a good mold releasing agent during dispersion with a binder resin. Due to this effective functioning of wax, there is no need to apply a mold releasing agent as oil to the fixing roller and the high temperature offset is improved. The examples of wax are vegetable wax like carnauba wax, cotton wax, haze wax (Japanese wax), rice wax, animal wax like bees wax and lanolin, mineral wax like ozokerite, selsyn, and petroleum wax like paraffin, micro crystalline, petrolatum. Other examples of wax apart from these natural waxes are synthetic hydrocarbon wax like Fischer Tropsch wax, polyethylene wax and synthetic wax like esters, ketones, and ethers. Furthermore, 12-hydroxy stearic acid amides, stearic acid amides, phthalic anhydride imide, fatty acid amides of chlorinated hydrocarbon, and homopolymers or copolymers (e.g. copolymers of n-stearyl acrylate ethyl methacrylate) of poly-n-stearyl methacrylate, poly-n-lauryl methacrylate, that are crystalline high polymer resins having a low molecular weight and crystalline high polymers having a long alkyl group in a side chain can also be used. The charge controlling agents and the mold releasing agents can be melted and kneaded together with the master batch and the binder resins and may also be added to an organic solvent at the time of dissolution and dispersion.

Inorganic fine particles are desirably used as an external additive to assist the fluidity, developing, and charging of the toner particles. The primary particle size of these inorganic fine particles is in a range of $5\times10^{-3}$ μm to 2 μm and the desirable range is from $5\times10^{-3}$ μm to 0.5 μm. Further, it is desirable that the specific surface area according to BET method is in a range of 20 $m^2$ to 500 $m^2$. It is desirable that the proportion of the inorganic fine particles to be used, is in a range of 0.01 weight percent to 5 weight percent of the toner and a range of 0.01 weight percent to 2.0 weight percent is particularly desirable. The concrete examples of inorganic fine particles are silica, alumina, titanium oxide, barium titanate, magnesium titanate, calcium titanate, strontium titanate, zinc oxide, tin oxide, silica sand, clay, mica, wollastonite, diatomaceous earth, chromium oxide, ceric oxide, red oxide, antimony trioxide, magnesium oxide, zirconium oxide, barium sulfate, barium carbonate, calcium carbonate, silicon carbide, and silicon nitride.

It is desirable to use hydrophobic silica fine particles together with hydrophobic titanium oxide fine particles as a fluidity imparting agent. Particularly, if a compound having an average particle size of both the fine particles less than $5\times10^{-2}$ μm is used and stirred to mix, the electrostatic force and the van der Waals force of the toner increases remarkably. Due to this, even by stirring and mixing inside the developing unit that is carried out to achieve the desired level of charging, the fluidity imparting agent is not detached from the toner. Therefore, a good image quality without any bright spot can be obtained and the amount of toner remained after the transferring of the image can be reduced. Although the fine particles of titanium oxide are environmentally stable and have very stable image density, there is a tendency of deteriorating the charging start up characteristics. For this reason, if the quantity added of the fine particles of titanium oxide is more than that of fine particles of silica, the sided effect is supposed to be more. However, with the quantity of addition of hydrophobic fine particles of silica and hydrophobic titanium oxide fine particles in a range of 0.3 weight percent to 1.5 weight percent, the charging start up characteristics are not affected to a great extent and the desired charging start up characteristics can be achieved. That is to say that a stable image quality can be achieved even when a copy is repeated.

Following is the explanation of a method for manufacturing the toner. The method explained here is a desirable method and the manufacturing of the toner is not restricted to this method only.

A method of manufacturing the toner includes the following steps.

(i) A toner material solution is prepared by allowing to disperse a colorant, a non-modified polyester, a polyester prepolymer having an isocyanate group, and a mold releasing agent in an organic solvent. It is desirable to have a volatile organic solvent having a boiling point below 100° C. since the removal after forming of the host particles of the toner is easy. Concretely, toluene, xylene, benzene, carbon tetrachloride, methylene chloride, 1,2-dichloromethane, 1,2,2-trichloromethane, trichloroethylene, chloroform, monochlorobenzene, dichloroethylidine, methyl acetate, ethyl acetate, methyl ethyl ketone, methyl isobutyl ketone etc. can be used solely or a combination of more than one of these. Particularly, aromatic solvents of toluene, xylene etc. and halogen hydrocarbons of methylene chloride, 1,2-dichloroethane, chloroform, carbon tetrachloride etc. are desirable. The amount of the organic solvent to be used is normally in a range of 0 to 300 parts of weight per 100 parts of weight of the polyester prepolymer. The desirable amount is in a range of 0 to 100 parts of weight and a range of 25 to 70 parts of weight is more desirable.

(ii) The toner material solution is emulsified in an aqueous medium in the presence of a surfactant and fine particles of resin. An aqueous medium may be solely water or an aqueous medium containing an organic solvent like an alcohol (methanol, isopropyl alcohol, ethylene glycol etc.), dimethyl formamide, tetrahydrofuran, a cellosorb (methyl cellosorb etc.), a lower ketone (acetone, methyl ethyl ketone etc.). The amount to be used of an aqueous medium per 100 parts of weight of the toner material solution is normally in a range of 50 to 2,000 parts of weight and it is desirable to have this amount in a range of 100 to 1,000 parts of weight. If the amount is less than 50 parts of weight, it affects the dispersion of the toner material solution and toner particles of a predetermined particle size cannot be obtained. An amount of more than 20,000 weight parts is not economical.

Further, to improve the dispersion in the aqueous medium, an appropriate dispersing agent like a surfactant, fine particles of resin are added. The examples of surfactants are anionic surfactants like alkyl benzene sulfonate, a-olefin sulfonate, ester phosphate, amine salts like alkyl amine salt, amino alcohol fatty acid derivatives, polyamine fatty acid derivatives, imidazoline, cationic surfactants of quaternary ammonium salt types like alkyl trimethyl ammonium salts, dialkyl dimethyl ammonium salts, alkyl dimethyl benzyl ammonium salts, pyridinium salts, alkyl isoquinolinium salts, benzethonium chloride, nonionic surfactants of fatty acid amide derivatives and polyhydric alcohol derivatives like alanine, dodecyl di (amino ethyl) glycine, di (octyl amino ethyl) glycine and ampholytic surfactants like N-alkyl-N, N-dimethyl ammonium betaine etc.

Furthermore, by using a surfactant having a fluoroalkyl group, a desired effect can be achieved with a very small quantity. The examples of desirable anionic surfactants having a fluoroalkyl group and fluoroalkyl carboxylic acids and their metal salts having a carbon number from 2 to 10, disodium perfluorooctane sulfonyl glutamate, sodium 3-[ω-fluoroalkyl (C6 to C11)oxy]-1-alkyl (C3 to C4) sulfonate, sodium 3-[ω-fluoroalkanoyl(C6 to C8)-N-ethyl amino]-1-propane sufonate, fluoroalkyl (C11 to C20) carboxylic acid and its metal salts, perfluoroalkyl carboxylic acid (C7 to C13) and its metal salts, perfluoroalkyl (C4 to C12) sulfonic acid and its metal salts, perfluorooctane sulfonic acid diethanol amide, N-propyl-N-(2-hydroxyethyl) perfluorooctane sulfonamide, perfluoroalkyl (C6 to C10) sulfonamide propyl trimehtyl ammonium salts, perfluoroalkyl (C6 to C10)-N-ethyl sulfonyl glycine salts, ester mono-perfluoroalkyl (C6 to C10) ethyl phosphate.

The examples of commercial products available are SURFLON S-111, S-112, S-113 (manufactured by ASAHI GLASS CO., LTD), FLUORAD FC-93, FC-95, FC-98, FC-129 (manufactured by SUMITOMO 3M CO., LTD.), UNIDINE DS-101, DS-102 (manufactured by DAIKIN INDUSTRIES, LTD.), MEGAFACE F-110, F-120, F-113, F-191, F-812, F-833 (manufactured by DAI NIPPON INK & CHEMICALS, INC.), EKTOP EF-102, 103, 104, 10 parachloro orthonitro aniline red, lithol fast scarlet G, brilliant fast scarlet, brilliant carmine BS, permanent 5, 112, 123A, 123B, 306A, 501, 201, and 204 (manufactured by TOCHEM PRODUCTS CO., LTD.), and FTERGENT F-100 and F-150 (manufactured by NEOS CO., LTD.).

The examples of cationic surfactants are primary aliphatic acids, secondary aliphatic acids or secondary amino acids having a fluoroalkyl group, quaternary aliphatic ammonium salts like perfluoroalkyl (C6 to C10) sulfonamide propyl trimethyl ammonium salts etc., benzalkonium salts, benzethonium chloride, pyridinium salts, imidazolinium salts. The examples of commercial products are SURFLON S-121 (manufactured by ASAHI GLASS CO., LTD.), FLUORAD FC-135 (manufactured by SUMITOMO 3M CO., LTD.), UNIDINE DS-202 (manufactured by DAIKIN INDUSTRIES, LTD.), MEGAFACE F-150, F-824 (manufactured by DAI NIPPON INK CHEMICALS, INC.), EKTOP EF-132 (manufactured by TOCHEM PRODUCTS CO., LTD.), FTERGENT F-300 (manufactured by NEOS CO., LTD.).

The fine particles of resin are added to stabilize the host particles of toner that are formed in the aqueous medium. Therefore, it is desirable that the fine particles of resin are added to make 10 to90 percent covering on the surface of the host particles of the toner. The examples are fine particles of methyl polymethacrylate having a particle size of 0.5 μm and 2 μm, fine particles of poly (styrene-acryl nitrile) having a particle size of 1 μm. The examples of commercial products are PB-200H (manufactured by KAO CORPORATION), SGP (manufactured by SOKEN CO., LTD.), TECHPOLYMER-SB (manufactured by SEKISUI CHEMICAL CO., LTD.), SGP-3G (manufactured by SOKEN CO., LTD.), and MICROPEARL (manufactured by SEKISUI CHEMICAL CO., LTD.). Moreover, inorganic dispersing agents like calcium phosphate-tribasic, calcium carbonate, titanium oxide, colloidal silica, and hydroxyapatite can also be used.

The dispersion droplets may be stabilized by a high polymer protective colloid as a dispersing agent that can be used both as fine particles of resin and of an inorganic dispersing agent. For example, acids like acrylic acid, methacrylic acid, α-cyanoacrylic acid, α-cyanomethacrylic acid, itanoic acid, crotonic acid, fumaric acid, maleic acid or anhydrous meleic acid, or (metha) acrylic monomers that include a hydroxyl group like β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro 2-hydroxypropyl acrylate, 3-chloro 2-hydroxypropyl methacrylate, diethylene glycol monoacrylic ester, diethylene glycol monomethacrylic ester, glycerin monoacrylic ester, glycerin monomethacrylic ester, N-methylol acryl amide, N-methylol methacryl amide, vinyl alcohols or ethers of vinyl alcohols like vinyl methyl ether, vinyl ethyl ether, vinyl propyl ether, or esters of compounds that include vinyl alcohol or a carboxyl group like vinyl acetate, vinyl propionate, vinyl butyrate, acryl amides, methacryl amides, diacetone acryl amide or their methylol compounds, acid chlorides like an acrylic acid chloride, a methacrylic acid chloride, nitrogenous substances like vinyl pyridine, vinyl pyrrolidine, vinyl imidazole, ethylene imines and homopolymers or copolymers of compounds having the heterocycles of these substances, polyoxyethylenes, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, polyoxyethylene nonyl phenyl ester, celluloses like methyl cellulose, hydroxyethyl cellulose, hydroxypropyl cellulose etc. are used.

The dispersion method is not restricted and a known apparatus like a low-speed shearing disperser, a high-speed shearing disperser, friction disperser, high-pressure jet disperser, and ultrasonic disperser can be used. Among these, the high-speed shearing disperser is desirable to make the particle size of a dispersing element from 2 μm to 20 μm. If the high-speed shearing is used, the revolutions per minute (rpm) are not restricted, but are normally in a range of 1,000 to 30,000 rpm. The desirable range of revolutions per minute is 5,000 to 20,000 rpm. The dispersing time is not restricted particularly. However, in a case of batch dispersion, the dispersing time is normally in a range of 0.1 minute to 5 minutes. The temperature during dispersion is normally in a range of 0° C. to 150° C. (under pressure) and the desirable range of temperature is 40° C. to 98° C.

(iii) While preparing an emulsified liquid, amine (B) is added an a reaction is allowed to take place with a polyester prepolymer (A) having an isocyanate group. This reaction involves a cross linking reaction and/or extension reaction of a molecular chain. The reaction time is selected according to the reactivity of the amine (B) with a structure of an isocyanate group of the polyester prepolymer (A) and is normally in a range of 10 minutes to 40 hours. The desirable reaction time is in a range of 2 hours to 24 hours. The reaction temperature is normally in a range of 0° C. to 150° C. and the desirable temperature is from 40° C. to 98° C. Moreover, a known catalyst can be used according to the requirement. Concrete examples of the catalyst are dibutyl tin laurate and dioctyl tin laurate.

(iv) On completion of the reaction, the organic solvent is removed from the emulsified dispersing element (reaction compound), washed, and dried to obtain the host particles of the toner. To remove the organic solvent, the whole system is heated up while laminar flow stirring. Around a particular temperature, the mixture is stirred vigorously and then the fusiform host particles of the tone rare prepared by carrying out diliquoring. Further, if a compound like a calcium phosphate salt that dissolves in an acid or an alkali is used as a dispersion stabilizer, after the calcium phosphate salt is dissolved in an acid like hydrochloric acid, the calcium phosphate salt is removed from the host particles of the toner according to a method of cleaning. It can also be removed by decomposition by an enzyme.

(v) A charge controlling agent is penetrated into the host particles of toner thus obtained, and inorganic fine particles like those of silica, titanium oxide etc. are added externally to obtain the toner. The penetrating of the charge controlling agent and the addition of the inorganic fine particles are carried out by a known method using a mixer etc. Thus, a toner having a sharp particle size distribution and with a small particle size, can be obtained easily. Moreover, by vigorous stirring for removing the organic solvent, the shape of particles from perfectly spherical to rugby ball shape can be controlled. Furthermore, the morphology of the surface can also be controlled between the smooth and the rough.

Figure 8A:
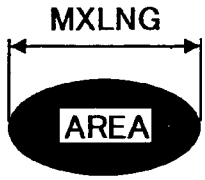
FIGS. 8A and 8B are schematic representations of shapes of toner particles for explanation of shape factor SF-1 and shape factor SF-2.
Figure 8B:
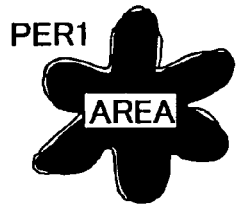

The toner in the present invention is a spherical particle toner that can be regulated by the following values of shape factor SF-1 and SF-2. FIG. 8A and FIG. 8B are schematic representations of shapes fo toner particles for explanation of shape factor SF-1 and shape factor SF-2. The shape factor SF-1 indicates the proportion of circularity of the toner particle and is represented by the following formula (1). The square of the maximum length MXLNG of the shape obtained by projecting the toner in a two dimensional plane, is divided by the graphic area AREA and is then multiplied by 100π/4 to obtain the value of the shape factor SF-1.

$$SF\text{-}1=\{(MXLNG)^2/AREA\}\times(100\pi/4) \quad (1)$$

When the value of SF-1 is equal to 100, the shape of the toner is perfectly circular and as the value of SF-1 increases, the shape goes on becoming indefinite. The shape factor SF-2 is a proportion of surface unevenness of the toner and is represented by the following formula. The square of the periphery PERI of the shape obtained by projecting the toner in two-dimensional plane is divided by the graphic area AREA and is then multiplied by 100π/4 to obtain the value of the shape factor SF-2.

$$SF\text{-}2=\{(PERI)^2/AREA\}\times(100\pi/4) \quad (2)$$

When the value of SF-2 is equal to 100, there is no unevenness on the surface of the toner and as the value of SF-2 decreases, the surface unevenness of the toner goes on becoming remarkable.

The shape factor was measured by taking a picture of the toner with a scanning electron microscope (S-800 manufactured by HITACHI SEISAKUSHO), analyzing it with an image analyzer (LUSEX3 manufactured by NIRECO CO., LTD.), and calculating the shape factor.

The particles of the toner in the present invention has the shape factor SF-1 in a range of 100 to 180 and the shape factor SF-2 in a range of 100 to 180. When the shape of the toner particles is closer to the circular shape, the contact of the toner particle with the other toner particle or the contact of the toner particle with the photosensitive drum 1 is a point contact, which improves the fluidity of the toner. Thus, the mutual adhesion of toner particles is deteriorated and the fluidity is improved thereby improving the transferring rate. However, due to deterioration of the adhesion power, the toner particles tend to enter the gap between the cleaning blade 8*a* and the photosensitive drum 1. Therefore, it is better to have the shape factors SF-1 and SF-2 more than 100. Furthermore, as the shape factors SF-1 and SF-2 increase, the toner is scattered on the image, thereby deteriorating the image quality. For this reason, it is advisable not to have the shape factors SF-1 and SF-2 more than 180.

Figure 9A:
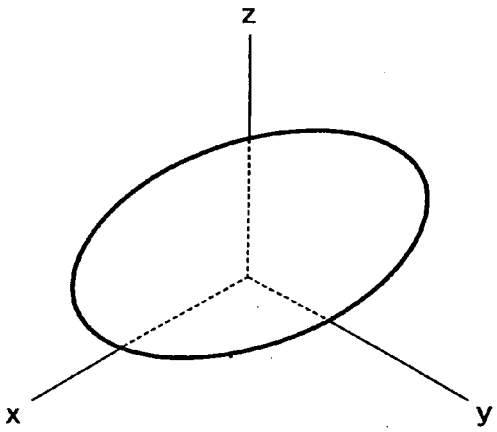
FIGS. 9A, 9B, and 9C are schematic representations of shapes of particles of toner in the present invention.
Figure 9B:
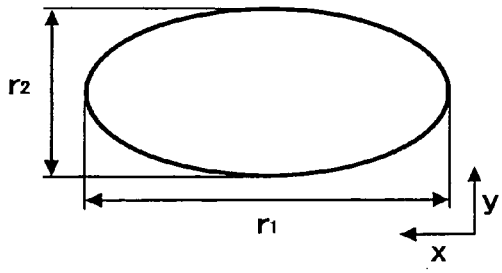
Figure 9C:
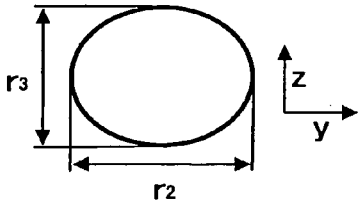

The particles of the toner in the present invention are spherical in shape and can be expressed in terms of the following shape regulation. FIGS. 9A, 9B, and 9C are schematic representations of shapes of particles of the toner in the present invention. In FIGS. 9A, 9B, and 9C, when the roughly spherical shaped particles of toners are regulated by a major axis r1, a minor axis r2, and a thickness r3 (provided r1≧r2≧r3), a ratio r2/r1 of the major axis and the minor axis (see FIG. 9B) is desirably in a range of 0.5 to 1.0 and a ratio r3/r2 of the thickness and the minor axis (see FIG. 9C) is desirably in a range of 0.7 to 1.0. If the ratio r2/r1 of the major axis and the minor axis is less than 0.5, the. reproducibility of dots and transferring rate is deteriorated due to shift from the perfectly spherical shape of particles, thereby not enabling to achieve the good quality image. Moreover, if the ratio r3/r2 of the thickness and the minor axis is less than 0.7, the shape is close to the flat shape and the high transferring rate as in case of spherical particles cannot be achieved. Particularly, If the ratio r3/r2 of the thickness and the minor axis is 1.0, the toner particles become rotating objects that rotate around the minor axis as the axis of rotation and the fluidity of the toner can be improved, where r1, r2, and r3 were measured by a scanning electron microscope (SEM) by taking pictures by changing an angle of field of vision and while observing.

The toner manufactured by this method can be used as a one component magnetic toner not using a magnetic carrier or as a non-magnetic toner. When this toner is used in a two-component developer, it is better to mix it with a magnetic carrier. It is desirable than the magnetic carrier is a ferrite including a bivalent metal like iron, magnetite, Mn, Zn, Cu and the volume average particle size is in a range of 20 μm to 100 μm. If the average particle size is smaller than 20 μm, the carrier may adhere easily to the photosensitive drum 1 during developing and if the particle size is more than 100 μm, the mixing with the toner is not good and the toner is not charge sufficiently. This tends to cause charging defect during the continuous use. Further, although the ferrite of Cu that includes Zn is desirable due to its high saturation magnetization, it can be selected according to the process of the image forming apparatus 100. The resins that coat the magnetic carrier are not restricted and resins like silicone resins, styrene-acrylic resins, fluorine contained resins, olefin resins can be used. In the method of manufacturing, the coating resin is dissolved in a solvent, sprayed in the fluid bed, and then coated on the core. In another method of manufacturing, the resin particles are adhered to the core particle electrostatically and then coated by thermal melting. The thickness of the coated resin is in a range of 0.05 μm to 10 μm and the desirable range of thickness is from 0.3 μm to 4 μm.

Thus, according to the first embodiment of the present invention, the toner or the particles adhered on a surface of an image carrier like a photosensitive drum and an intermediate transferring body or a support of a recording member like a paper carrying belt can be removed efficiently by the polishing blade. Thus, a cleaning unit that enables to maintained good cleaning over long period of time even in a case of developing that uses toner having spherical shaped particles and small sized particles, can be provided. Moreover, by providing such cleaning unit, it is possible to provide a cartridge, an image forming apparatus and toner that enable to achieve an image that is not deteriorated even after use over a long period of time.

Figure 10:
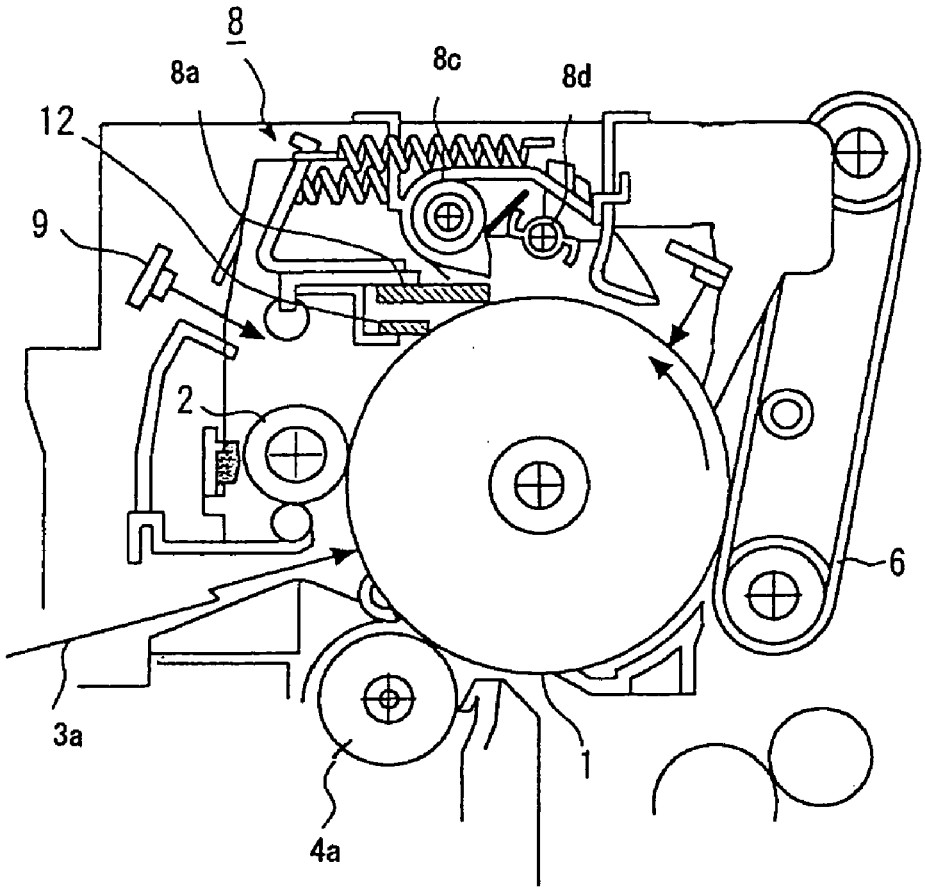
FIG. 10 is a schematic diagram of an image forming apparatus in a second embodiment of the present invention.
Figure 11:
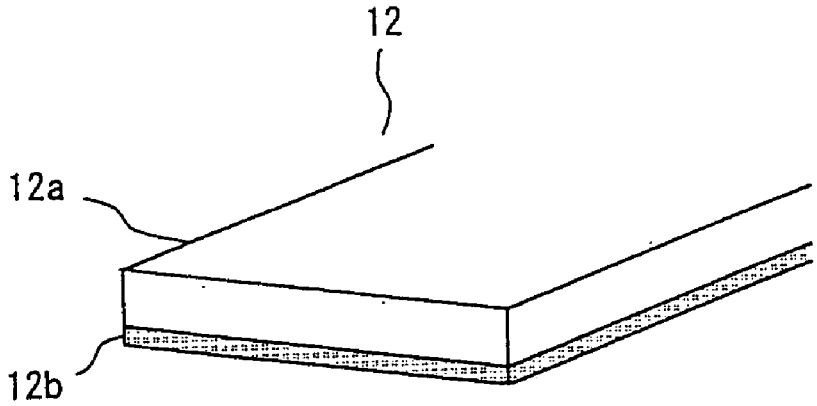
FIG. 11 is an illustration of a second cleaning blade (polishing blade) in the second embodiment of the present invention.

Following is the detailed explanation of a second embodiment based on drawings. FIG. 10 is a schematic diagram of an image forming apparatus in the second embodiment of the present invention. The image forming apparatus in this embodiment, similar to the first embodiment, includes a photosensitive drum 1 that is an image carrier, a charging unit 2, an exposing unit 3, a developing unit 4, a transferring unit 6, a cleaning unit 8 and a decharging lamp 9. The charging unit 2 is either adjacent to or in contact with the photosensitive drum 1 and charges the drum uniformly. The exposing unit 3 forms an electrostatic latent image on the charged photosensitive drum 1. The developing unit 4 visualizes the electrostatic latent image and converts it into a toner image. The transferring unit 6 transfers the toner image on a recording medium. The cleaning unit 8 cleans a surface of the photosensitive drum 1 after transferring of the image. The decharging lamp 9 decharges the charge remained on the photosensitive drum 1.

Following is the detailed explanation of the cleaning unit 8 in the present invention. The cleaning unit 8 includes two cleaning blades in order of a first cleaning blade 8*a* and a second cleaning blade 12 from an upstream side of the direction of rotation of the photosensitive drum 1. The cleaning unit 8 further includes a toner recovery vane 8*d* that recovers the toner that is cleaned and a toner recovery coil 8*c* that carries the toner. The first cleaning blade is made of a material like a metal, a resin, a rubber etc. It is desirable to use fluorine contained rubber, silicone rubber, butyl rubber, butadiene rubber, isoprene rubber, and urethane rubber. Among these rubbers, the urethane rubber is particularly desirable.

The second cleaning blade 12, on the other hand, is a polishing blade that has a blade base layer 12*a* and an abrasive layer 12*b* that contains abrasive particles. The blade base layer 12*a* is formed by a material like a rubber, a resin, a metal etc. and is desirably formed by rubber similarly as in the first cleaning blade 8*a*. It is particularly desirable that the blade base layer 12*a* is formed by urethane rubber. The abrasive layer 12*b* is formed by dispersing abrasive particles in the rubber. If the blade base layer 12*a* is formed by rubber, it is desirable that the hardness of the rubber that is used for the abrasive layer 12*b* is in not less than 65 degrees and not more than 85 degrees. If the hardness is less than 65 degrees, the blade wears away in a short time and if the hardness is more than 85 degrees, the edge of the blade tend to be chipped.

The examples of abrasive particles are nitrides like silicone nitride, silicates like aluminum silicate, magnesium silicate, mica, calcium silicate, calcareous substances like gypsum, carbides like silicon carbide, boron carbide, tantalum carbide, titanium carbide, aluminum carbide, zirconium carbide, and oxides like ceric oxide, chromium oxide, titanium oxide, aluminum oxide etc. Among these, ceric oxide is desirable as abrasive particles due to its excellent abrasive capability.

It is desirable that the average particle size of abrasive particles is not less than 0.05 μm and not more than 100 μm. If the average particle size is less than 0.05 μm, the particles are too fine and it is difficult to have a uniform dispersion of particles in the rubber thereby resulting in insufficient abrasion by the polishing blade. On the other hand, if the average particle size is more than 100 μm, the excessive abrasion causes scratches on the surface of the photosensitive drum 1, hence not desirable.

It is desirable that the abrasive particle content in the abrasive layer is not less than 0.5 weight percent and not more than 50 weight percent. If the abrasive particle content is less than 0.5 weight percent, the dispersion of the particles is sparse and uniform abrasion is not possible. If the abrasive particle content is more than 50 weight percent, the density of particles is too high and they tend to come off. Higher content of abrasive particles also increases the cost.

The thickness of the blade base layer 12*a* and the abrasive layer 12*b* can be set voluntarily. However, it is desirable that the thickness of the abrasive layer 12*b* is not less than 0.5 percent of the thickness of the second cleaning blade 12. If the thickness is less of the abrasive layer 12*b* is less than 0.5 percent of the thickness of the second cleaning blade 12, the thickness is not sufficient for wearing and quality cannot be maintained in the course of time. If the thickness is more than 0.5 percent of the thickness of the second cleaning blade 12, the elasticity of the rubber cannot be displayed and the surface of the photosensitive drum cannot be polished uniformly.

The double layer second cleaning blade 12 is disposed such that the abrasive layer 12 is in contact with the photosensitive drum 1. The first cleaning blade 8*a*, mainly removes the toner remained after the transferring of an image and the paper dust. The second cleaning blade 12 scrape the surface of the photosensitive drum 1 by the abrasive surface and removes the substances adhered and filming substances on the photosensitive drum 1 that mainly contains the inorganic fine particles escaped from the toner.

The second cleaning blade 12 also removes the toner and paper dust that is left uncleaned by the first cleaning blade 8*a*. The abrasive layer 12 in which the abrasive particles are dispersed over certain width, is allowed to be in contact with the photosensitive drum 1. This results in a uniform scraping of a membrane (thin film) on the surface of the photosensitive drum and does not cause any defect on the photosensitive drum 1. As compared to other cleaning blade coated with abrasive on the surface, the abrasive particles on the cleaning blade 12 do not come off and not scraped off easily. This enables to provide a cleaning unit that can maintain good cleaning capability over long period of time.

Following is the explanation of the relationship between the first cleaning blade 8*a* and the second cleaning blade 12. If the blade base layer 12*a* of first cleaning blade 8*a* and the second cleaning blade 12 are made of rubber, it is desirable that the hardness of rubber in the blade base layer 12*a* of the second cleaning blade is more than that of rubber in the blade base layer of the first cleaning blade. This is for removing with stronger abrasive power the adhered particles and filming substances that could not be removed by the first cleaning blade 8*a*.

It is desirable that both of the first cleaning blade 8*a* and the second cleaning blade 12 are in contact with the photosensitive drum 1 in the countering form. The first cleaning blade 8*a* being in contact with the drum 1 in the countering form can efficiently remove the paper dust and toner remained on the photosensitive drum 1 after transferring of an image. Moreover the second cleaning blade 12 being in contact with the drum 1 in the countering form, the adhered substances on the photosensitive drum are removed by the shock imparted by the striking of the second cleaning blade 12 against the photosensitive drum, thereby achieving effective cleaning.

It is desirable that the angle of contact of the second cleaning blade with the surface of the photosensitive drum 1 is not less than 5 degrees and not more than 25 degrees. If the angle of contact is less than 5 degrees, the longitudinal surface of the second cleaning blade 12 comes is contact with the sensitive drum 1, thereby causing creeping. The creeping reduces the abrasion capability in a course of time. If the angle of contact is more than 25 degrees, the second cleaning blade bend during the reverse rotation of the photosensitive drum 1 at the time of finishing of a job.

It is desirable that the contact pressure exerted by the second cleaning blade 12 on the photosensitive drum 1 is not less than 10 gf/cm and not higher than 60 gf/cm. If the contact pressure is less than 10 gf/cm, the substances adhered on the photosensitive drum 1 tend tend to run through due to the low contact pressure and the adhered substances cannot be removed sufficiently. If the contact pressure is higher than 60 gf/cm, the scraping of the membrane (thin film) on the photosensitive drum 1 increases and affects the life of the photosensitive drum.

A dent is formed on the surface of the photosensitive drum 1 by the hardness of the second cleaning blade and the pressure of contact. It is desirable that the dent is not less than 0.2 mm and not more than 1.5 mm. If the second cleaning blade 12 is installed such that the dent is as given above, there is no excessive increase in the scraping of the membrane (thin film) of the surface of the photosensitive drum 1 and the second cleaning blade 12 can sufficiently remove the substances adhered on the surface of the photosensitive drum 1.

Figure 12:
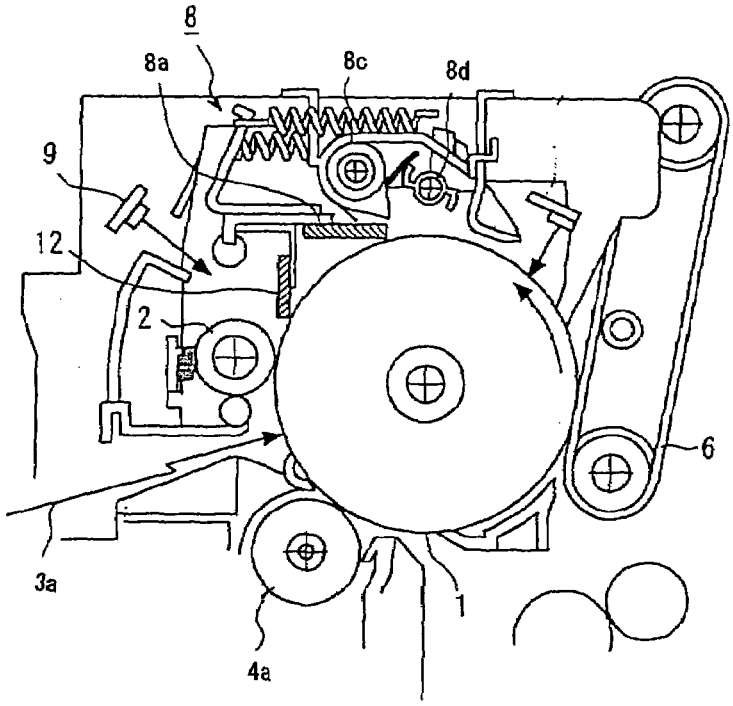
FIG. 12 is a schematic diagram of an image forming apparatus in a second embodiment of the present invention.

FIG. 12 is a schematic diagram of an image forming apparatus in another embodiment of the present invention. As shown in FIG. 12, the first cleaning blade 8*a* may be in contact with the photosensitive drum 1 in the countering form and the second cleaning blade 12 may be in contact with the photosensitive drum in the trailing form. The reason for installing the first cleaning blade 8*a* in the countering form is similar to that mentioned earlier. Whereas, by installing the second cleaning blade 12 in the trailing form the capability of removing the substances adhered on the photosensitive drum 1 is slightly deteriorated. However, since there is almost no toner input to the second cleaning blade 12, it is susceptible to bending and this bending is avoided by the contact of the second cleaning blade 12 in the trailing form. For the reason similar to the contact in the countering form, it is desirable that the contact pressure exerted by the second cleaning blade 12 is not less than 10 gf/cm and not higher than 60 gf/cm. This contact pressure exerted by the second cleaning blade enables good cleaning of the photosensitive drum 1.

In the cleaning units shown in FIG. 10 and FIG. 12, apart from continuous contact all the time, of the second cleaning blade 12 with the photosensitive drum 1, the cleaning unit may be structured to allow an intermittent contact of the second cleaning blade 12 with the photosensitive drum 1. Such structure needs to be equipped with an alienating mechanism that uses a solenoid, a cam etc. The intermittent contact of the second cleaning blade 12 reduces the scraping of the membrane (thin film) on the photosensitive drum 1 thereby making it's life longer.

Figure 13:
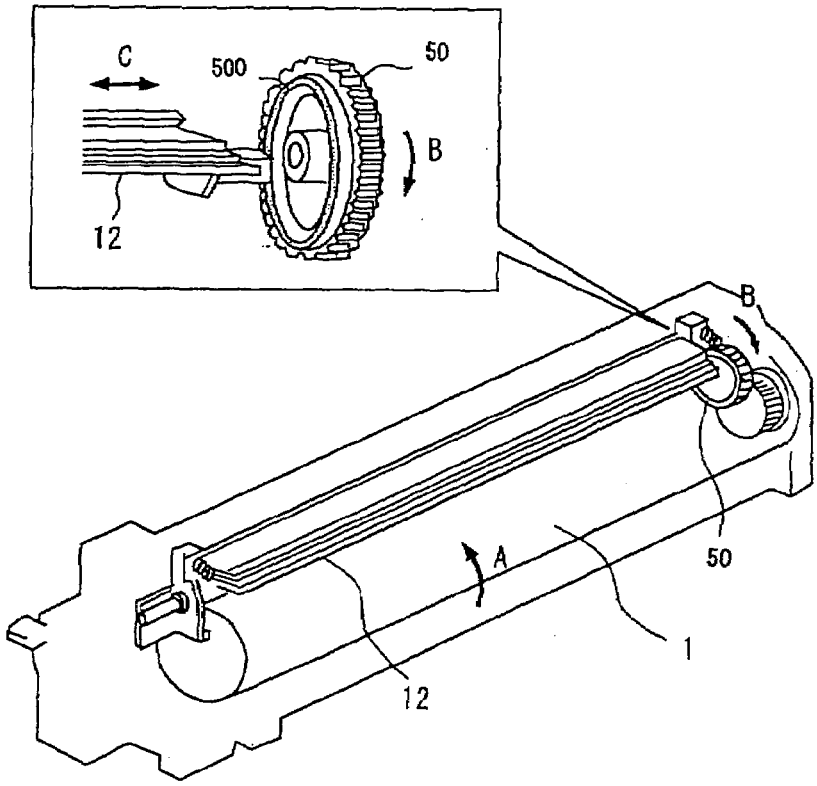
FIG. 13 is an illustration of vibration mechanism of the second cleaning blade in the second embodiment of the present invention.

Moreover, it is desirable to provide an vibration mechanism to the second cleaning blade 12. FIG. 13 is an illustration of the vibration mechanism of the second cleaning blade. The second cleaning blade 12 is supported by a pressurized holder not shown in the diagram. A bearing is provided on a riveted end of the pressurized holder. The bearing is striking against the cam surface 50*a* of the gear 50 having oscillating cam. If the photosensitive drum rotates in a direction of an arrow A, the gear 50 having oscillating cam rotates in a direction of an arrow B and the second cleaning blade 12 follows the gear 50 and rotates in the direction of the arrow. By equipping the second cleaning blade 12 with the vibration mechanism, even if there is some deviation in dispersion of abrasive particles in the abrasive layer 12*a*, this deviation can be made up for the membrane (thin film) on the photosensitive drum 1 can be scraped uniformly. Although the first cleaning blade 8*a* doesn't contain any abrasive particles, since it is scraping the photosensitive drum 1 slightly, it may be structured such that it oscillates together with the second cleaning blade by the same vibration mechanism as that for the second cleaning blade.

To scrape the membrane (thin film) on the photosensitive cylinder still uniformly, it is desirable to allow the first cleaning blade 8*a* and the second cleaning blade 12 with different phases. To allow the two cleaning blades to oscillate with the different phases, a cam surface of different phase is to be installed inside the cam surface 50*a* of the gear 50 having the oscillating cam, thereby structuring a mechanism that oscillates the two blades by different cam surfaces.

Thus, the cleaning unit 8 in the present invention is formed by integrating the photosensitive drum with units selected from the charging unit and the developing unit as a detachable process cartridge in the image forming apparatus. With this process cartridge, even for the image formation process with developing that uses toner of small particle size, the cleaning capability of the photosensitive drum can be maintained over a long period of time without any deterioration of image quality.

The image forming apparatus equipped with the cleaning unit in the present invention is not restricted only to the structures in FIG. 10 and FIG. 12 and may be a structure equipped with an intermediate transferring body that carries the toner image after transferring from the photosensitive drum 1 and a structure equipped with a plurality of photosensitive drums for forming a multicolor image. An image forming apparatus equipped with the cleaning unit 8 in the present invention having a developing unit that uses toner having circularity not less than 0.90, particles having shape close to circular shape, and the volume average particle size in a range of 3 μm to 10 μm proves to be very effective. The toner having a small particle size and particles having a shape close to circular shape tend to enter the gap between the photosensitive drum and the cleaning blade and run through the gap.

Moreover, if the toner has a small particle size, the content of additives like wax and inorganic fine particles in the toner particles tend to be high. These additives separate from the toner and adhere to the surface of the photosensitive drum thereby contaminating it. However, with the cleaning unit 8 in the present invention, the first cleaning blade 8*a* removes the paper dust and toner remained after the transferring of image on the photosensitive drum 1, and the second cleaning blade 12 scrapes and removes adhered substances containing wax and inorganic fine particles as main components, on the photosensitive drum 1. The second cleaning blade 12 can also remove the paper dust and toner that is left uncleaned by the first cleaning blade 8*a*. The second cleaning blade 12 has two layers viz. the blade base layer 12*a* and the abrasive layer 12*b*. Since the abrasive particles are dispersed over a certain width the particles do not come off from the layer thereby enabling to maintain good cleaning capability over a long period of time.

Following is the explanation of the toner used in the image forming apparatus in the present invention. The toner contains a colorant and a polyester as it's main components. At least fine particles of silica are added externally to the toner host particles that contain a charge controlling agent. The ratio M/T of weight M of the charge controlling agent on surfaces of host particles of the toner and weight T of the charge controlling agent in overall host particles of the toner is not less than 100 and not more than 1,000. The ratio M/T is a value measured by X-ray photoelectron spectroscopy (XPS) of each element up to 5th period in the periodic table excluding H, C, O, and noble gases that exist only in the charge controlling agent and do not exist in components other than the charge controlling agent.

This toner contains polyester that has a low glass transition point (Tg) as a binder resin. Therefore, it has an excellent fixing at a low temperature. Moreover, since the charge controlling agent is mainly on the surface of the toner particles as shown by the weight ratio M/T, this toner has a excellent stability of charging characteristics. The external additive containing an inorganic fine particles like silica are added externally on the surface of the toner particles to have an auxiliary effect on charging and fluidity of toner particles.

The inorganic fine particles of silica, titania etc are negatively charged, and in this toner having a charge controlling agent that is negatively charged similar to salts and metal salts of salicylic acid, there is an electric repulsion between the external additive and the charge controlling agent on the surface. Since the charge controlling agent is hard, the inorganic fine particles like that of silica etc. tend to separate from the toner. It was made clear by the experiments carried out by the inventor of the present invention that among inorganic fine particles, particularly the fine particles of silica tend to separate easily from the toner and adhere to the surface of the photosensitive drum thereby affecting the image quality. However, in the image forming apparatus equipped with the cleaning unit in the present invention, by removing this toner the substance adhered on the surface of the photosensitive drum can be removed, thereby maintaining a high image quality.

Following is the explanation of constituent materials and method for manufacturing of the toner. The toner in the second embodiment of the present invention contains a colorant, a polyester, a charge controlling agent, a mold releasing agent, and an external additive. The method for manufacturing of the toner is similar to that mentioned in the first embodiment and hence is omitted here.

EXAMPLES

Following is the explanation of the present invention based on the examples below. However, the present invention is not restricted to these examples only.

690 weight parts of 2 moles adduct of bisphenol A ethylene oxide and 256 parts of terephthalic acid are added to a reaction vessel that has a cooling pipe, an agitator, and a pipe for introducing nitrogen and polycondensated at a temperature of 230° C. for eight hours at atmospheric pressure. The pressure is then reduced to 10 mmHg to 15 mmHg and the reaction mixture is allowed to react for five hours. The mixture is cooled down to 160° C. 18 weight parts of phthalic anhydride are added to this and the mixture is allowed to react for two hours to obtain non-modified polyester (a).

Manufacturing of Polyester Prepolymer 800 weight parts of 2 moles adduct of bisphenol A ethylene oxide, 180 weight parts of isophthalic acid, 60 weight parts of terephthalic acid, and 2 weight parts of dibutyl tin oxide are added to a reaction vessel that has a cooling pipe, an agitator, and a pipe for introducing nitrogen and allowed to react at a temperature of 230° C. for eight hours at atmospheric pressure. The pressure is then reduced to 10 mmHg to 15 mmHg and while dehydrating, the reaction mixture is allowed to react for five hours. The mixture is cooled down to 160° C. 32 weight parts of phthalic anhydride are added to this and the mixture is allowed to react for two hours. Then the mixture is cooled down to 80° C. and allowed to react with 170 weight parts of isophorone diisocyanate in ethyl acetate for two hours. Thus, a polyester prepolymer (b) containing an isocyanate group is obtained.

30 weight parts of isophorone diamine and 70 weight parts of methyl ethyl ketone are added in a reaction vessel that has an agitator and a thermometer. The reaction mixture is allowed to react at 50° C. for five hours to obtain a ketimine compound (c).

15.4 weight parts of the polyester prepolymer (b), 60 weight parts of the non-modified polyester (a), 78.6 weight parts of ethyl acetate are added to a beaker and dissolved by stirring. 10 parts of rice wax (melting point 83° C.) that is a mold releasing agent, 4 parts of copper phthalocyanine blue pigments are added to this mixture and stirred at 12,000 rpm with TK homomixer at 60° C. to dissolve and disperse uniformly. 2.7 weight parts of the ketimine compound (c) are added to this and dissolved. The reaction mixture formed is a toner material solution (d). 306 weight parts of ion exchange water, 265 weight parts of 10 percent suspension solution of calcium phosphate tribasic, 0.2 weight part of sodium dodecyl benzene sulfonate, and fine particles of styrene/acrylic resin having a particle size of 0.20 μm are added in a beaker and dispersed uniformly. The mixture is heated to 60° C. and the toner material solution (d) is added to the mixture while stirring it at 12,000 rpm with TK homomixer. This mixture is then stirred for 10 minutes. 500 g of this mixture is taken in a Kolben that has an agitator rod and a thermometer. The mixture is heated to 45° C. and while allowing the reaction with the polyester prepolymer (a) and the ketimine compound (c) under reduced pressure for half an hour, the solvent is removed. Then the mixture is separated by filtration, washed, and dried. After drying the mixture, it is air classified to obtain the toner host particles.

100 weight parts of the toner host particles obtained, and 0.25 weight part of a charge controlling agent (BONTRON 84; manufactured by ORIENT CHEMICAL INDUSTRIES, LTD.) is poured in a Q-shaped mixer (manufactured by MITSUI MINING CO., LTD.). The speed of the turbine shaped vane is set to 50 m/sec and mixer is operated for two minutes and stopped for one minute. This cycle is repeated five times. Thus, the total operating time is two minutes. Further, 0.5 weight part of hydrophobic silica (H2000; manufactured by CLARIANT JAPAN CO., LTD.) is added and the mixture is mixed at a speed of 15 m/sec for 30 seconds and mixing is stopped for one minute. This cycle is repeated five times and cyan toner is obtained. Then, 0.5 weight part of hydrophobic silica, and 0.5 weight part of hydrophobic titanium oxide are mixed in Henschel mixer to obtain toner (1).

4 weight parts of copper phthalocyanine blue pigments used in manufacturing of toner (1) are replaced by 6 weight parts of benzidine yellow pigments, 6 parts of rhodamine lake pigments, and 10 parts of carbon black respectively and toners (2) to (4) are manufactured by the similar manufacturing method.

Image was formed by using these toners (1) to (4) in the image forming apparatus shown in FIG. 10. The image forming operation is as given below. The photosensitive drum 1 is rotated in anticlockwise direction. The photosensitive drum 1 is decharged by the decharging lamp 9 and the surface electric potential is set to an average of standard electric potential in a range of 0 volts to −150 volts. Then, the photosensitive drum 1 is charged by the charging unit 2 and the surface electric potential becomes around −1000 volts. Further, the photosensitive drum 1 is exposed by the exposing unit 3 and the surface electric voltage on an area (image area) where the light is irradiated is in a range of 0 volts to −200 volts. The toner on a sleeve adheres on the image area by the developing unit 4. The photosensitive drum 1 on which the toner image is formed, rotates. A recording paper is carried from the paper feeding section that is not shown in the diagram with a timing such that the front tip of the recording paper and a tip of the image they coincide (match) at the transferring unit 6. The toner image on the surface of the photosensitive drum 1 is transferred in the transferring unit 6. The recording paper is then carried to a fixing unit that is not shown in the diagram where the toner is melted and fixed due to heat and pressure. The recording paper is then discharged out from the image forming apparatus.

The substances adhered and untransferred toner remained on the photosensitive drum 1 is scraped off by the first cleaning blade 8*a* and the second cleaning blade 12 of the cleaning unit 8. The residual charge is eliminated by the decharging lamp 9. The photosensitive drum 1 is in the initial condition with no toner and substance adhered on it and ready for forming the next image.

Thus, according to the second embodiment of the present invention, the first cleaning blade and the second cleaning blade are installed from the downstream direction of the direction of rotation of the image carrier. The second cleaning blade is a polishing blade having a double layer structure of the blade base layer and an abrasive layer that contains abrasive particles. Therefore, it is possible to provide a cleaning unit that can remove the substances adhered on the surface of the image carrier and maintain the cleaning capability over a long period of time. Particularly, in the image forming apparatus that uses toner having spherical shaped particles having small particle size for developing, the substances adhered on the surface of the photoreceptor formed around a core of inorganic fine particles that are separated from the surface of the toner particles, can also be removed in effective manner. Thus, the image forming apparatus equipped with the cleaning unit in the present invention has an excellent cleaning capability and there is no deterioration of image quality over a long period of time.

Thus, in the cleaning unit in the present invention, a blade made of a material like rubber is allowed to be in contact with the surface of the rotating body as a cleaning blade and cleans the substances deposited on the surface. The polishing blade is installed in the downstream of the cleaning blade and polishes the surface of the rotating body. Thus, the cleaning unit, the process cartridge, and the image forming apparatus, and the toner is useful in an image forming apparatus like a copying machine, a laser printer, a laser facsimiles etc. that in which the cleaning blade and the polishing blade cleans an image carrier like a photosensitive drum, a support of a recording medium like a transferring belt, and a paper carrying belt. Particularly, they are useful in an apparatus or a system that has a mechanism to remove the substances adhered to the rotating body and initializes it.

The present document incorporates by reference the entire contents of Japanese priority documents, 2002-276754 filed in Japan on Sep. 24, 2003, 2003-055089 filed in Japan on Mar. 3, 2003 and 2003-179391 filed in Japan on Jun. 24, 2003.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A cleaning unit installed in an image forming apparatus comprising:

a first blade located where a part of the first blade is in contact with a rotator constituting the image forming apparatus to remove residue on the rotator; and a second blade located where a part of the second blade is in contact with the rotator and having an abrasive layer, to remove residue not removed by the first blade, wherein the abrasive layer has a thickness of approximately from 0.5 to 50 percent of a thickness of the second blade.

2. The cleaning unit according to claim 1, wherein the rotator is an image carrier.

3. The cleaning unit according to claim 1, wherein the rotator is a paper carrier.

4. The cleaning unit according to claim 1, wherein the second blade is in contact with the rotator over a length approximately from 0.01 to 5 millimeters from a tip of the second blade.

5. The cleaning unit according to claim 1, wherein the second blade has a base layer not including abrasive particles.

6. The cleaning unit according to claim 5, wherein the base layer is made of a material selected from the group consisting of a rubber, a resin, and a metal.

7. The cleaning unit according to claim 5, wherein the base layer is made a rubber with a hardness of approximately from 65 to 85 degrees.

8. The cleaning unit according to claim 5, wherein the first blade is made of a rubber, and the base layer is made a rubber with a hardness of more than a hardness of the first blade.

9. The cleaning unit according to claim 1, wherein the abrasive layer is made of a rubber with a hardness of approximately from 65 to 100 degrees.

10. The cleaning unit according to claim 1, wherein the abrasive layer is made of a rubber with a hardness of approximately from 85 to 100 degrees.

11. The cleaning unit according to claim 1, wherein the abrasive layer is made of a rubber with a coefficient of dynamic friction of not more than 1.5.

12. The cleaning unit according to claim 1, wherein the abrasive layer includes abrasive particles of approximately from 0.5 to 50 weight percent.

13. The cleaning unit according to claim 1, wherein the abrasive layer includes ceric oxide.

14. The cleaning unit according to claim 1, wherein the abrasive layer has abrasive particles with an average particle size of approximately from 0.05 to 100 micrometers.

15. The cleaning unit according to claim 1, wherein the second blade has a cut edge formed by cutting a part of an edge of the second blade, the cut edge being in contact with the rotator.

16. The cleaning unit according to claim 15, wherein the cut edge is formed at the time of forming of the second blade from an elastic sheet.

17. The cleaning unit according to claim 16, wherein the cut edge is cut in an inclined direction with respect to the elastic sheet.

18. The cleaning unit according to claim 1, wherein a contact region to the rotator, of the second blade, is cut by idle running of the rotator.

19. The cleaning unit according to claim 1, wherein the second blade is in contact with the rotator in a trailing location with respect to a rotation direction of the rotator.

20. The cleaning unit according to claim 19, wherein the first blade is in contact with the rotator in a countering direction with respect to a rotation direction of the rotator.

21. The cleaning unit according to claim 1, wherein the first and second blades are in contact with the rotator in a countering direction with respect to a rotation direction of the rotator.

22. The cleaning unit according to claim 1, wherein the second blade is in contact with the rotator, with a contact angle of approximately from 5 to 25 degrees.

23. The cleaning unit according to claim 1, wherein the second blade is in contact with the rotator, with a contact pressure of approximately from 10 to 80 gf/cm.

24. The cleaning unit according to claim 1, wherein the second blade is in contact with the rotator, with a contact pressure of approximately from 10 to 60 gf/cm.

25. The cleaning unit according to claim 1, wherein the second blade is in contact with the rotator to make a dent of approximately from 0.2 to 1.5 millimeters in the rotator.

26. The cleaning unit according to claim 1, wherein the second blade has a vibration mechanism.

27. A cleaning unit installed in an image forming apparatus comprising:

a first blade located where a part of the first blade is in contact with a rotator constituting the image forming apparatus to remove residue on the rotator; and a second blade located where a part of the second blade is in contact with the rotator and having an abrasive layer, to remove residue not removed by the first blade, wherein the abrasive layer is made of an elastic material and has abrasive particles accounting for approximately from 50 to 90 percent of a volume of a contact region to the rotator.

28. A cleaning unit installed in an image forming apparatus comprising:

a first blade located where a part of the first blade is in contact with a rotator constituting the image forming apparatus to remove residue on the rotator; and a second blade located where a part of the second blade is in contact with the rotator and having an abrasive layer, to remove residue not removed by the first blade, wherein the entire second blade is the abrasive layer.

29. A cleaning unit installed in an image forming apparatus comprising:

a first blade located where a part of the first blade is in contact with a rotator constituting the image forming apparatus to remove residue on the rotator; and a second blade located where a part of the second blade is in contact with the rotator and having an abrasive layer, to remove residue not removed by the first blade, wherein the abrasive layer has abrasive particles with a ratio to a volume of a contact region to the rotator, the ratio being gradual with regard to a thickness of the abrasive layer.

30. A cleaning unit installed in an image forming apparatus comprising:

a first blade located where a part of the first blade is in contact with a rotator constituting the image forming apparatus to remove residue on the rotator; and a second blade located where a part of the second blade is in contact with the rotator and having an abrasive layer, to remove residue not removed by the first blade, wherein the abrasive layer has a layer accounting for not less than 50 percent of a volume of a contact region to the rotator, and the layer has a thickness of approximately from 5 to 100 micrometers.

31. A cleaning unit installed in an image forming apparatus comprising:

a first blade located where a part of the first blade is in contact with a rotator constituting the image forming apparatus to remove residue on the rotator; and a second blade located where a part of the second blade is in contact with the rotator and having an abrasive layer, to remove residue not removed by the first blade, wherein the abrasive layer includes a mixture of abrasive particles of at least one of different average particle size and different materials.

32. A cleaning unit installed in an image forming apparatus comprising:

a first blade located where a part of the first blade is in contact with a rotator constituting the image forming apparatus to remove residue on the rotator; and a second blade located where a part of the second blade is in contact with the rotator and having an abrasive layer, to remove residue not removed by the first blade, wherein the abrasive layer includes ceric oxide, and wherein the abrasive layer includes ceric oxide with a purity of not less than 80 percent.

33. A cleaning unit installed in an image forming apparatus comprising:

a first blade located where a part of the first blade is in contact with a rotator constituting the image forming apparatus to remove residue on the rotator; and a second blade located where a part of the second blade is in contact with the rotator and having an abrasive layer, to remove residue not removed by the first blade, wherein the second blade has a cut edge formed by cutting a part of an edge of the second blade, the cut edge being in contact with the rotator, and wherein the cut edge has a curvature of approximately from 5 to 150 micrometers.

34. A cleaning unit installed in an image forming apparatus comprising:

a first blade located where a part of the first blade is in contact with a rotator constituting the image forming apparatus to remove residue on the rotator; and a second blade located where a part of the second blade is in contact with the rotator and having an abrasive layer, to remove residue not removed by the first blade, wherein the second blade has a vibration mechanism, and wherein the first blade has a vibration mechanism to vibrate with a phase that is different than a vibration phase of the second blade.

35. A process cartridge that is detachably installed in an image forming apparatus, comprising:

a rotator where residue is adhered in the image forming process; and a cleaning unit that has a first blade located where a part of the first blade is in contact with the rotator to remove residue on the rotator; and a second blade located where a part of the second blade is in contact with the rotator and having an abrasive layer, to remove residue not removed by the first blade, wherein the abrasive layer is made of an elastic material and has abrasive particles accounting for approximately from 50 to 90 percent of a volume of a contact region to the rotator.

36. The process cartridge according to claim 35, wherein the second blade has a base layer not including abrasive particles.

37. An image forming apparatus comprising:

a rotator where residue is adhered in an image forming process; and a cleaning unit that has a first blade located where a part of the first blade is in contact with the rotator to remove residue on the rotator; and a second blade located where a part of the second blade is in contact with the rotator and having an abrasive layer, to remove residue not-removed by the first blade, wherein the abrasive layer has a thickness of approximately from 0.5 to 50 percent of a thickness of the second blade.

38. The image forming apparatus according to claim 37, further comprising:

an image carrier that carries a latent image;

a charging unit that uniformly charges a surface of the image carrier;

an exposing unit that exposes the surface of the image carrier charged according to image data and writes the latent image on the surface;

a developing unit that supplies toner to the latent image formed on the surface of the image carrier and visualizes the image; and a transferring unit that transfers the image visualized on the image carrier, to a paper, wherein the rotator is the image carrier.

39. The image forming apparatus according to claim 37, further comprising:

a first image carrier that carrier a latent image;

a charging unit that uniformly charges a surface of the first image carrier;

an exposing unit that exposes the surface of the first image carrier charged according to image data and writes the latent image on the surface;

a developing unit that supplies toner to the latent image formed on the surface of the first image carrier and visualizes the image;

a second image carrier;

a transferring unit that transfers the image visualized on the first image carrier to the second image carrier once and transfers the image transferred on the second image carrier, to a paper, wherein the rotator is the second image carrier.

40. The image forming apparatus according to claim 37, further comprising:

an image carrier that carries a latent image;

a charging unit that uniformly charges a surface of the image carrier;

an exposing unit that exposes the surface of the image carrier charged according to image data and writes a latent image on the surface;

a developing unit that supplies toner to the latent image formed on the surface of the image carrier and visualizes the image;

a transferring unit that transfers the image visualized on the image carrier to a paper; and a paper carrier that carries the paper, wherein the rotator is the paper carrier.

41. The image forming apparatus according to claim 37, wherein the toner has a volume average particle size of approximately from 3 to 8 micrometers and a ratio Dv/Dn, of the volume average particle size Dv to a number average particle size Dn, of approximately from 1.00 to 1.40.

42. The image forming apparatus according to claim 37, wherein the toner is prepared by allowing a toner solution to undergo at least one of a cross linking reaction and an extension reaction in an aqueous medium, and the toner solution is a mixture of a polyester prepolymer that has a functional group with a nitrogen atom, a polyester, a colorant, and a mold releasing agent in an organic solvent.

43. The image forming apparatus according to claim 37, wherein the toner has a shape factor SF-1 of approximately from 100 to 180 and a shape factor SF-2 of approximately from 100 to 180.

44. The image forming apparatus according to claim 37, wherein the toner includes particles each having roughly spherical shape.

45. The image forming apparatus according to claim 37, wherein the toner has host particles with a charge controlling agent, is obtained by externally adding at least fine particles of silica and is prepared by a process includes preparing a toner solution by dispersing a colorant, a polyester, a prepolymer, and a mold releasing agent in an organic solvent;

emulsifying the toner solution in an aqueous medium with a surfactant and fine particles of a resin;

allowing a prepolymer to undergo polyaddition reaction in the toner solution emulsified; and cleaning and drying the solution reacted.

46. The image forming apparatus according to claim 37, wherein the charge controlling agent has a ratio M/T, of weight M of the charge controlling agent on surfaces of the host particles to weight T of the charge controlling agent in the host particles, of approximately from 100 to 1000.

47. An image forming apparatus comprising:

a rotator where residue is adhered in an image forming process; and a cleaning unit that has a first blade located where a part of the first blade is in contact with the rotator to remove residue on the rotator; and a second blade located where a part of the second blade is in contact with the rotator and having an abrasive layer, to remove residue not-removed by the first blade, wherein the toner has a shape regulated by a major axis r1, a minor axis r2, and a thickness r3, a ratio of the minor axis r2 to the major axis r1 is in a range of 0.5 to 1 and a ratio r3/r2 of the thickness r3 to the minor axis r2 is in a range of 0.7 to 1.0, where $r1 \leqq r2 \leqq r3$.

* * * * *